US007761942B2

(12) United States Patent
Benzo et al.

(10) Patent No.: US 7,761,942 B2
(45) **Date of Patent: *Jul. 27, 2010**

(54) BED WITH ADJUSTABLE PATIENT SUPPORT FRAMEWORK

(75) Inventors: Eduardo Rene Benzo, Celina (AR); Mario Cesar Eleonori, Martinez (AR)

(73) Assignee: Bedlab, LLC, Cumming, GA (US)

( * ) Notice: Subject to any disclaimer, the term of this patent is extended or adjusted under 35 U.S.C. 154(b) by 91 days.

This patent is subject to a terminal disclaimer.

(21) Appl. No.: 11/869,696

(22) Filed: Oct. 9, 2007

(65) Prior Publication Data

US 2009/0089930 A1 Apr. 9, 2009

(51) Int. Cl.
*A47B 7/00* (2006.01)
*A47B 7/02* (2006.01)
*A61G 1/00* (2006.01)

(52) U.S. Cl. ..... 5/613; 5/617; 5/618; 5/89.1

(58) Field of Classification Search ..... 5/607, 5/608, 613, 617, 618, 81.1 R, 89.1, 88.1
See application file for complete search history.

(56) References Cited

U.S. PATENT DOCUMENTS

| | | | |
|---|---|---|---|
| 2,113,286 | A | 4/1938 | White |
| 2,168,649 | A | 8/1939 | Johnson |
| 2,534,471 | A | 12/1950 | Norheim |
| 2,613,371 | A | 10/1952 | Keyes |
| 2,906,259 | A | 9/1959 | Adair |
| 3,013,281 | A | 12/1961 | Steiner |
| 3,132,351 | A | 5/1964 | Huntress et al. |
| 3,302,218 | A | 2/1967 | Stryker |
| 3,434,165 | A | 3/1969 | Keane |

(Continued)

FOREIGN PATENT DOCUMENTS

| | | | |
|---|---|---|---|
| BR | PI 0100713-0 | A | 9/2001 |

(Continued)

OTHER PUBLICATIONS

Levytar, "Multimedia: In this section you will find visual materials on our products," "Levytar: The unique electronic rotation bed," 2004 (c), pp. 1-2, published at http://levytar.com/Ingles/Multimedia.htm.

(Continued)

*Primary Examiner*—Michael Trettel
*Assistant Examiner*—Jonathan J Liu
(74) *Attorney, Agent, or Firm*—Eric W. Cernyar

(57) ABSTRACT

An adjustable bed comprises a hospital bed frame chassis, an articulatable, multi-sectioned base platform mounted on the chassis, an adjustable patient support framework mounted on the base platform, and a patient support surface overlying the adjustable patient support framework and base platform. The adjustable patient support framework preferably includes two main parts: an adjustable torso support litter mounted on the articulatable torso-supporting section of the base platform; and an adjustable hip support litter mounted on the articulatable hip-supporting section of the base platform. Each of these support litters comprise a plurality of independently adjustable vertices or segments oriented at or near the periphery of the overlying patient support surface. Modulation of the patient support surface is accomplished through two conceptually distinct mechanisms—(1) articulation of the base platform and (2) movement of the vertices and/or segments of the adjustable patient support framework.

28 Claims, 34 Drawing Sheets

U.S. PATENT DOCUMENTS 3,701,170 A * 10/1972 Bond ..... 4/597
3,737,924 A 6/1973 Davis
3,827,089 A 8/1974 Grow
3,875,598 A 4/1975 Foster et al.
4,084,274 A 4/1978 Willis et al.
4,085,471 A 4/1978 DiMatteo et al.
4,094,024 A 6/1978 Benoit et al.
4,109,329 A 8/1978 Tupper
4,114,209 A 9/1978 Sandlin
4,175,550 A 11/1979 Leininger
4,244,358 A 1/1981 Pyers
4,277,857 A 7/1981 Svehaug
4,357,722 A 11/1982 Thompson
4,375,706 A 3/1983 Finnhult
4,395,786 A 8/1983 Casey et al.
4,432,353 A 2/1984 Vrzalik
4,451,944 A 6/1984 James
4,463,463 A 8/1984 Kaneko
4,554,930 A 11/1985 Kress
4,578,833 A 4/1986 Vrzalik
4,658,450 A 4/1987 Thompson
4,658,451 A 4/1987 Taniguchi
4,685,159 A 8/1987 Oetiker
4,763,643 A 8/1988 Vrzalik
4,866,796 A 9/1989 Robinson et al.
4,868,937 A 9/1989 Connolly
4,872,657 A 10/1989 Lussi
5,005,231 A 4/1991 Lonardo
5,005,240 A 4/1991 Vrzalik
5,018,712 A 5/1991 Schaefer
5,023,967 A 6/1991 Ferrand
5,095,562 A 3/1992 Alexander
5,103,511 A 4/1992 Sequin
5,142,719 A 9/1992 Vrzalik
5,152,024 A 10/1992 Chrones et al.
5,181,288 A 1/1993 Heaton et al.
5,224,228 A 7/1993 Larrimore
5,230,113 A 7/1993 Foster et al.
5,269,031 A 12/1993 Alexander
5,274,862 A 1/1994 Palmer, Jr. et al.
5,299,334 A 4/1994 Gonzalez
5,502,853 A 4/1996 Singleton et al.
5,515,561 A 5/1996 Suggitt et al.
5,611,096 A 3/1997 Bartlett et al.
5,613,252 A 3/1997 Yu et al.
5,640,729 A 6/1997 Marino
6,038,717 A 3/2000 Persson
6,282,736 B1 9/2001 Hand et al.
6,287,253 B1 9/2001 Ortega et al.
6,341,393 B1 1/2002 Votel
6,360,386 B1 3/2002 Chuang
6,374,435 B1 4/2002 Leininger et al.
6,502,260 B2 1/2003 Viljoen et al.
6,536,056 B1 3/2003 Vrzalik et al.
6,561,047 B1 5/2003 Gladney et al.
6,651,281 B1 11/2003 Figiel
6,691,348 B2 2/2004 Plummer et al.
6,892,405 B1 5/2005 Dimitriu
2005/0160530 A1 7/2005 Taguchi et al.
2005/0166323 A1* 8/2005 Kawakami et al. ..... 5/610
2009/0094744 A1* 4/2009 Benzo et al. ..... 5/613
2009/0094745 A1* 4/2009 Benzo et al. ..... 5/608
2009/0094746 A1* 4/2009 Ferraresi et al. ..... 5/609

FOREIGN PATENT DOCUMENTS

EP 0674893 B1 1/2002

OTHER PUBLICATIONS

Levytar, "Products: CM 2000 Model," "Levytar: The unique electronic rotation bed," 2004 (c), pp. 1-2, published at http://levytar.com/Ingles/CM2000.htm.
Levytar, "Products: AC 2000 Model," "Levytar: The unique electronic rotation bed," 2004 (c), pp. 1-2, published at http://levytar.com/Ingles/AC2000.htm.
Levytar, Powerpoint entitled "Levytar III AC 2000," Feb. 18, 2002.

* cited by examiner

BED WITH ADJUSTABLE PATIENT SUPPORT FRAMEWORK

RELATED DISCLOSURES

This invention relates to, and this application incorporates herein by reference, the following disclosures filed as part of the Patent and Trademark Office's Document Disclosure Program: the disclosure by Eduardo R. Benzo and Rodolfo W. Ferraresi entitled Levita-Bed System, filed on Dec. 12, 2005, and assigned document number 592241; the disclosure by Eduardo R. Benzo, Rodolfo W. Ferraresi, and Mario C. Eleonori entitled Dynamic Multipositional Hospital Bed, filed on Feb. 15, 2006, and assigned document number 596795; the disclosure by Eduardo R. Benzo, Rodolfo W. Ferraresi, and Mario C. Eleonori entitled Dynamic Multipositional Hospital Bed, filed on Jul. 6, 2006, and assigned document number 603707; the disclosure by Eduardo R. Benzo, Rodolfo W. Ferraresi, and Mario C. Eleonori entitled Use and Control Methods for Multipositional Beds, filed on May 12, 2006, and assigned document number 610034; and the disclosure by Eduardo R. Benzo, Rodolfo W. Ferraresi, and Mario C. Eleonori entitled System for Virtual Communication between Patient and the Rest, filed on Dec. 5, 2006, and assigned document number 610042.

FIELD OF THE INVENTION

This invention relates generally to specialized therapeutic beds and surfaces, and more particularly, to beds with mechanically adjustable therapeutic surfaces for the treatment and prevention of a patient immobility induced complications.

BACKGROUND OF THE INVENTION

A normal person, while sleeping, generally turns or moves frequently. This mobility restores blood circulation to the compressed areas of the subcutaneous tissues. When a patient is partially or permanently immobilized, the blood supply in the area under pressure is restricted or blocked. If the blood supply is not restored it will be predisposed to induce local injury, which might lead to decubitus or pressure ulcers (bedsores). Pressure sores occur most commonly in the buttocks, sacrum, hips and heels. When infected, these sores can become life threatening. Besides pressure ulcers, immobility can cause other pathologies including pneumonia, atelectasis, thrombosis, urinary tract infections, muscle wasting, bone demineralization and other undesired events.

To prevent such complications, many medical care facilities buy or rent extraordinarily expensive beds and therapeutic support surfaces, costing upwards of seventy-five thousand dollars each or more than $100/day in rent. Other medical and nursing care facilities rely on nurses and aides to turn bedridden patients manually, preferably at least every 2 hours—day and night—to relieve tissue compression and reestablish blood flow. Both alternatives put a significant strain on limited medical care resources.

The manual procedure, in particular, has many drawbacks. The need to frequently turn and move patients is costly, and requires an increased ratio of personnel to patient. The immobilized patient is also awakened every time he is mobilized. If family members are the caregivers, they need to be in attendance 24 hours a day, which might lead to fatigue and distress.

Many attempts have been made to solve the above-mentioned problems utilizing mattresses filled with air, water or gel. These solutions generally fall into one or both of two categories—very expensive solutions, and inadequate or unreliable solutions. Today, the medical bed industry has largely abandoned strictly or predominantly mechanical approaches in favor of costly therapeutic support surfaces that use managed multi-compartment air mattresses to distribute pressure and laterally rotate the patient. These approaches, moreover, have drawbacks in that patients typically float unsecured on the patient support surface. Thus, there is still a very great need for fresh, less costly solutions to problems of patient immobility.

SUMMARY OF THE INVENTION

An adjustable bed is provided that comprises a hospital bed frame chassis, an articulatable, multi-sectioned base platform mounted on the chassis, an adjustable patient support framework mounted on the base platform, and a patient support surface overlying the adjustable patient support framework and base platform. The adjustable patient support framework preferably comprises a plurality of independently adjustable vertices (or points) and segments mounted on the torso and hip support sections of the base platform. For each of the independently adjustable vertices and segments, a dedicated independently controllable actuator assembly is provided to move that vertex or segment independently of the other adjustable vertices and segments of the adjustable patient support framework.

The independently adjustable vertices and segments are oriented at or near the periphery or perimeter of the patient support surface. Also, in the preferred embodiment, various side support bars link together pairs of the independently adjustable vertices, and a mattress-supporting foundation—for supporting the patient support surface—is mounted on the side support bars and independently adjustable segments. This mattress-supporting foundation preferably comprises a sheet, a net, straps, bands, or webbing material. Alternatively, the mattress-supporting foundation is incorporated into the patient support surface itself. Either way, modulation of the patient support surface is accomplished through two conceptually distinct mechanisms—(1) articulation of the base platform and (2) movement of the vertices and/or segments of the adjustable patient support framework.

The preferred embodiment of the adjustable patient support framework has two main parts: an adjustable torso support litter mounted on the articulatable torso-supporting section of the base platform; and an adjustable hip support litter mounted on the articulatable hip-supporting section of the base platform. Preferably, independently controllable actuators are provided to independently control the movement of each of the four corners of the adjustable torso support litter. The adjustable hip support litter, by contrast, is preferably controlled through controlled movement of the sides of the hip support litter. In such embodiments, two independently controllable actuators are adequate to independently control the movement of the two sides of the hip support litter.

The adjustable patient support framework facilitates a wide variety of modulations of the patient support surface. Using the patient support framework, the patient support surface can be modulated to support a patient in either the supine or prone positions, cause lateral rotation of the patient from side to side, and rotate the torso and legs in opposite directions, in a twisting mode. Using the patient support framework, the patient support surface can also be modulated to selectively squeeze the periphery of the patient support surface on either side of a patient's waist or hips or both to distribute pressure over a wider area and help maintain the patient in position during other bed movements. The patient support surface can also be modulated to selectively elevate the torso and hip-supporting areas of the patient support surface relative to a pelvic-supporting area of the patient support surface, to thereby relieve pressure in that region. The patient support surface can also be modulated to facilitate ingress and egress of a patient onto or off of the patient support surface.

These and other desired therapeutic effects can be achieved by acting on the preferably at least six independently movable points or segments of perimeter area, in conjunction with various movements of the articulating base platform.

Many of these desired therapeutic effects can also be achieved with simpler embodiments of the adjustable patient support framework, involving fewer independently movable vertices or segments, or involving paired vertices or segments that are moved with common (rather than independent and dedicated) actuator assemblies. It is the inventors' intent that the scope of any of the claims be defined by the language of the claims, and not narrowed by reference to the preferred embodiments described in this summary or in the detailed description of the invention.

The present invention can be characterized as including—but should not be, unless specified by the claim language, characterized as being limited by—one or more of the following non-exhaustive list of aspects, features, and advantages, separately or in combination:

providing an adjustable bed having flexible support surfaces supported about their perimeter areas by independently controllable mechanical actuators;

modulating a patient support surface through control of the support surface's perimeter area;

securing a patient that lies on a patient support surface by causing the perimeter of the support surface to embrace and hold the patient by the waist and/or hip area;

providing a mechanism that facilitates selective movement of specific anatomical areas;

providing an adjustable bed that enables one to selectively raise and rotate the torso, hip, and/or leg area if desired;

providing an mechanism to position the patient in a semi-seated position such that the pressure on the sacral area is relieved of pressure with the mattress while the patient lies in supine position;

providing a mechanism for rotating a patient to one side while relieving pressure on a patient's throcanter's head;

providing a mechanism to facilitate patient ingresses or egresses from the lateral side of bed;

providing a mechanism that can equally support a patient in the supine or prone positions, to facilitate inspecting or cleaning;

regulating the movement of the mechanical actuators through patient mobilization routines programmed into a controller and administered at desired times and frequencies;

treating patients suffering temporary of permanent immobility, e.g. poly-traumatic events, burns, pulmonary diseases, spinal cord injuries, traumatic brain injuries, stroke, etc.;

preventing and treating immobility-induced complications in bedridden patients;

significantly lowering the personnel to patient ratio;

facilitating the usual workload of nursing personnel via inducing in a programmed manner the patient's mobilization;

creating a hugging support for the mattress such that a patient can be contained firmly and securely;

increasing the support surface of a patient in an ergonomic form and adjusting to the anthropometric patient's characteristics;

generating continuity among the points of support of the thorax, hip and legs in a manner that precludes anatomically unacceptable positions;

transporting medically compromised persons in airplanes; and caring for premature or critically sick infants.

DETAILED DESCRIPTION

In describing preferred and alternate embodiments of the technology described herein, as illustrated in FIGS. 1-38, specific terminology is employed for the sake of clarity. The technology described herein, however, is not intended to be limited to the specific terminology so selected, and it is to be understood that each specific element includes all technical equivalents that operate in a similar manner to accomplish similar functions.

I. Mechanical Overview

A. Main Structures of the Adjustable Bed

Figure 1:
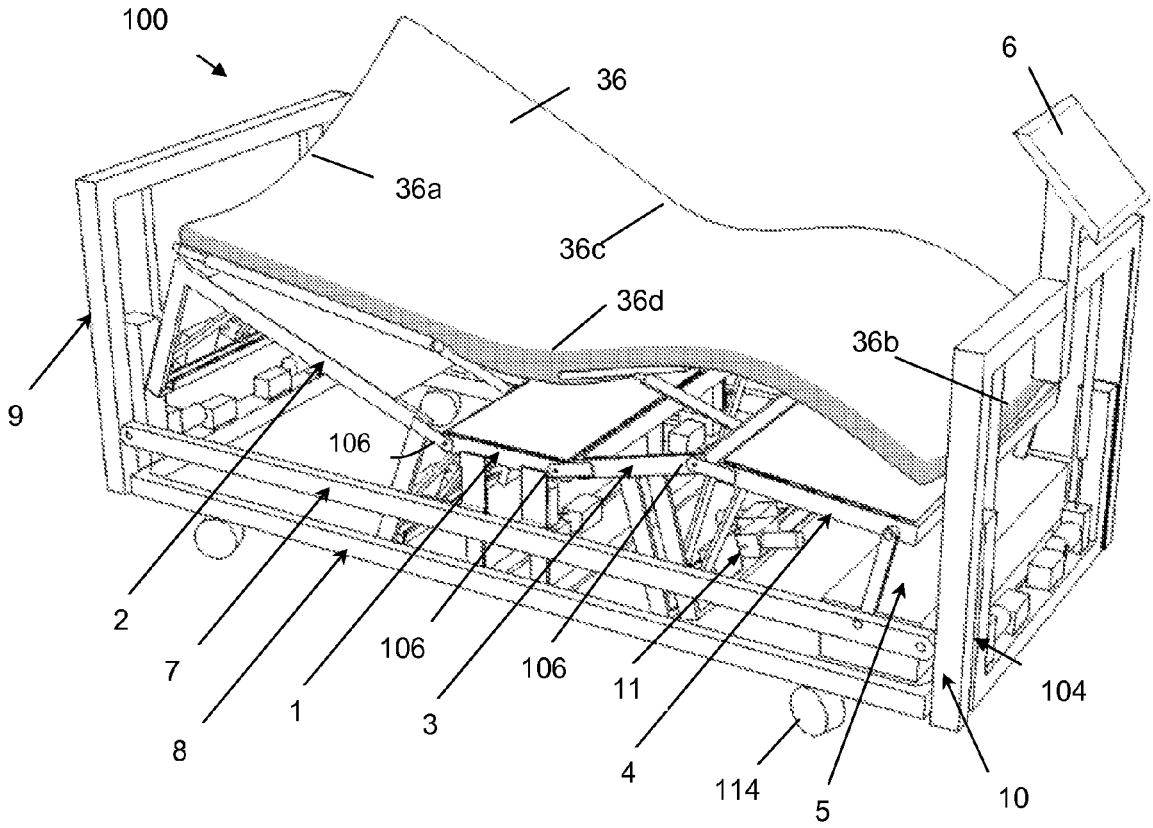
FIG. 1 illustrates a perspective view of one embodiment of the adjustable bed, adapted especially for a hospital environment.

FIG. 1 illustrates a perspective view of a preferred embodiment of an adjustable bed 100 embodied as a hospital bed. The adjustable bed 100 offers support to the patient from the edge of the headboard 9 to the edge of the footboard 10 and through the width of the bed. The adjustable bed comprises 100 comprises a versatile patient support structure 60 (FIG. 4) to support and modulate an overlaying patient support surface 36. This patient support structure 60 is mounted on an upper chassis 7, which is in turn mounted on a lower chassis 8. Mechanical linear actuators 104 (FIGS. 1, 4) positioned between the upper chassis 7 and a lower chassis 8 allow the head and foot ends of the upper chassis to be independently raised or lowered with respect to the lower chassis 8. Accordingly, the upper chassis can be moved between raised, lowered, Trendelenburg, and reverse-Trendelenburg positions. The lower chassis 8 is mounted on wheels 114. The headboard 9 and footboard 10 are attached to opposite ends of the upper chassis 7.

In other embodiments, not shown, side rails may be added to the upper chassis 7, and specially designed attachments may be provided to increase the width of the patient support structure 60 to accommodate bariatric patients.

Figure 9:
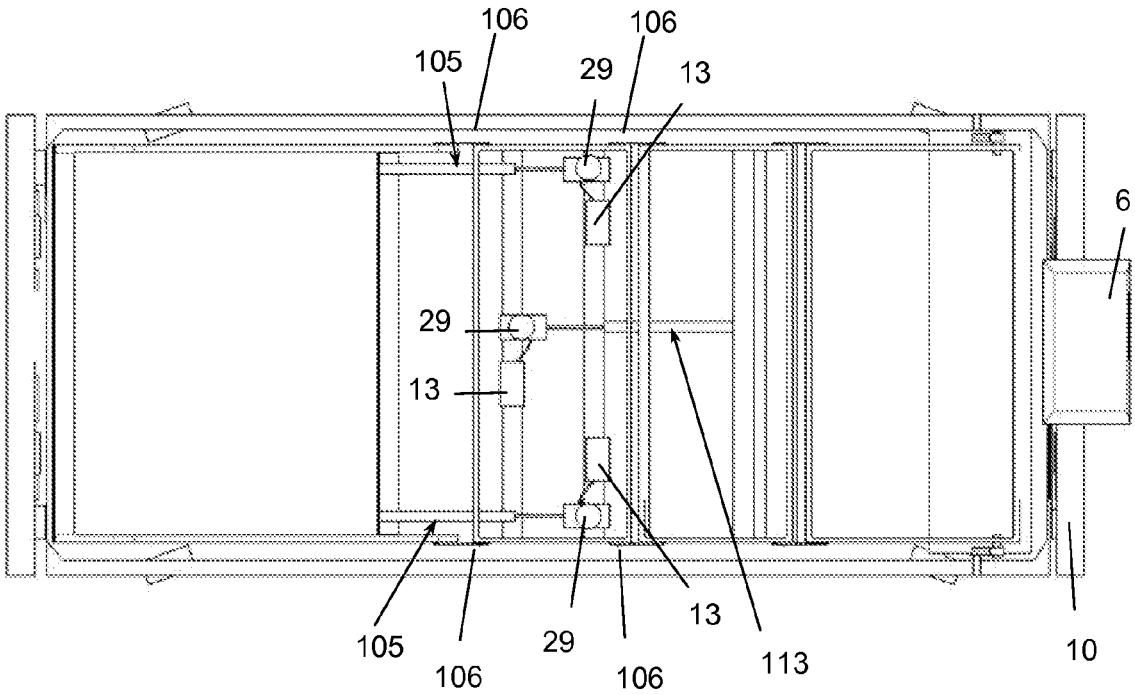
FIG. 9 illustrates a partial top plan view of linear actuators for torso elevation and leg elevation.

FIG. 9 illustrates a partial top plan view of mechanisms for torso and leg elevation. Linear actuators 105 are mounted between the central support structure 1 and the torso support structure 2 for driving the torso support structure 2 and causing it to rotate about an axis 66 (FIG. 44) defined by hinge 106 (coinciding with a transversal axis of patient). Another linear actuator 113 is mounted between the central support structure 1 and the hip support structure 3 for driving the hip support structure 3 and causing it to rotate about an axis 86 (FIG. 44) defined by hinge 106 (coinciding with a transversal axis of patient). In FIG. 9, the linear actuators 105 and 113 are each driven by electric motors 29, which are each, in turn, activated by a peripheral control unit 13. It will be understood that various types of actuators 105 and 103, including hydraulic and pneumatic actuators, could take the place of the electrically driven actuator.

Figure 10:
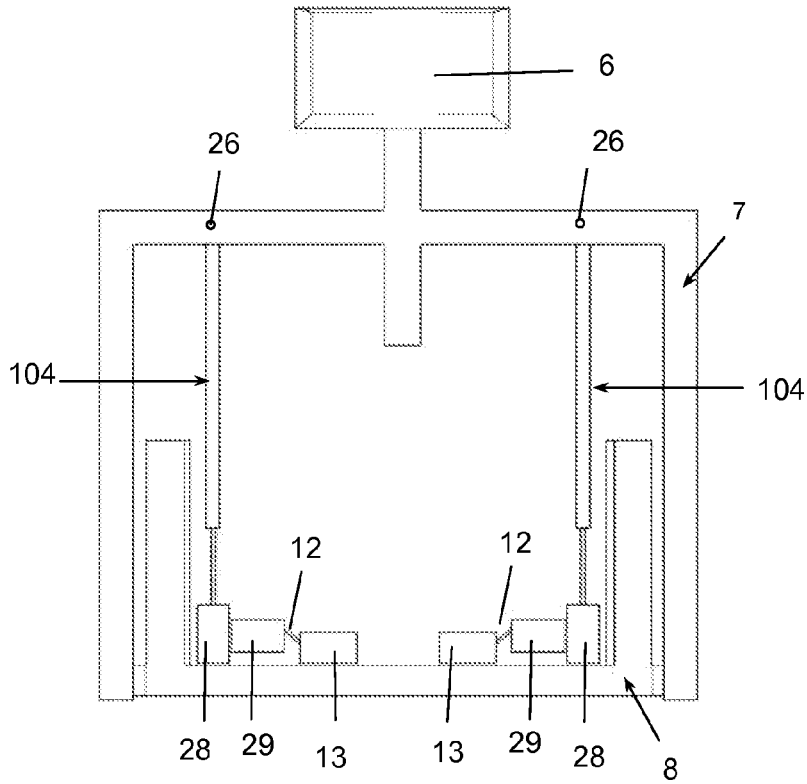
FIG. 10 illustrates a partial front plan view of linear actuators for elevation of legs and bed headboard sides.

FIG. 10 illustrates a partial front plan view of the mechanisms for elevation of headboard side 9 and footboard side 10. The upper chassis 7 is raised or lowered by linear actuators 104 linked to upper chassis by hinges 26. The bases of linear actuators 104 are mounted on the lower chassis 8. The linear actuators 104 are propelled by an assembly of an electric motor 29 and a reducer 28. The motor 29 is activated by a peripheral control unit 13, to which it is connected by cable 12. In this way, if all linear actuators 104 are activated, both headboard and footboard sides will be lifted or descended from the floor. When only the footboard linear actuator 104 are activated, the Trendelemburg defined movement is realized. On the other hand, if only the headboard linear actuators 104 are activated, the anti-Trendelemburg defined movement is achieved.

Preferably, the adjustable bed 100 is built with components and material sufficient to support a patient weighing as much as 1000 pounds.

B. Basic Components of the Patient Support Structure Used to Modulate the Patient Support Surface Viewed from top to bottom (FIG. 44), the patient support structure 60 comprises a mechanically adjustable patient support framework 95 mounted on an articulatable, multi-sectioned base platform 90. Viewed from the head end to the foot end (FIG. 1), the patient support structure 60 is made up of a plurality of adjacent lateral patient support sections. An articulatable torso support structure 2, supporting no more than 60% (and preferably much less than 60%) of the patient support surface 36, is positioned to support the torso and head of a patient lying on the patient support surface 36. An articulatable hip and upper-leg support structure 3 is positioned to support the hip and upper legs of the patient. An articulatable lower-leg support structure 4 is positioned to support the lower legs of the patient. Finally, a preferably non-articulatable central or pelvic support structure 1, rigidly attached to the upper chassis 7 between the hingedly adjoining torso support structure 2 and the hingedly adjoining hip and upper-leg support structure 3, is positioned to support—or relieve pressure upon, as explained in connection with FIGS. 30A-30C—the pelvic area of the patient.

In a preferred embodiment, the torso support structure 2 and the hip and upper-leg support structure 3 each comprise versatile support litters mounted upon articulating base structures. In particular, the torso support structure 2 comprises an adjustable torso support litter 68 mounted on an articulatable torso support base structure 62, and the hip and upper-leg support structure 3 comprises an adjustable hip and upper leg support litter 69 mounted on an articulatable torso hip support base structure 63. Together, the adjustable torso support litter 68 and the adjustable hip and upper leg support litter 69 make up the adjustable patient support framework 95.

The combination of the torso support base structure 62 (which articulates about transverse axis 66 (FIG. 44)), the preferably non-articulating central or pelvic support structure 1, the hip support base structure 63 (which articulates about transverse axis 86), and the lower-leg support structure 4 (which articulates about transverse axis 87) make up the articulatable, multi-sectioned base platform 90. As further shown in FIG. 1, a hinge 106 connects the inferior side of the torso support structure 2 to the central support structure 1 and allows the torso support structure 2 to be rotated about transverse axis 66 (FIG. 44) for torso elevation. Another hinge 106 connects the superior side of the hip support structure 3 to the central support structure 1 and allows the hip support structure 3 to be rotated about transverse axis 86 for elevation of the patient's upper legs. Yet another hinge 106 connects the superior side of the lower-leg support structure 4 to the hip support structure 3 and allows the lower-leg support structure 4 to be rotated about transverse axis 87 for flexing of the legs and/or elevation of the lower legs.

The patient support surface 36, which may comprise a polyurethane foam mattress or, optionally, a mattress filled with air, water or gel, has a head end 36*a*, a foot end 36*b*, a right side 36*c*, and a left side 36*d* (FIG. 1). The patient support surface 36 also has an upper-body supporting section 82, a midsection 83, and a lower-body supporting section 84 (FIG. 44), and has sufficient flexibility so that desired modulations of the patient support surface 36 can be effected through articulation of the base platform 90 and movements of the adjustable patient support framework 95.

The periphery 81 (FIG. 44) of the patient support surface 36 can be characterized as consisting of a head-side peripheral portion 120 adjoining a right-torso-adjacent peripheral portion 121 adjoining an intermediate right-side peripheral portion 122 adjoining a right-hip-adjacent peripheral portion 123 adjoining a right-calf-adjacent peripheral portion 124 adjoining a foot-side peripheral portion 125 adjoining a left-calf-adjacent peripheral portion 126 adjoining a left-hip-adjacent peripheral portion 127 adjoining an intermediate left-side peripheral portion 128 adjoining a left-torso-adjacent peripheral portion 129 adjoining the head-side peripheral portion 120. The density and thickness of the patient support surface 36 may be selected based on the weight and condition of the patient.

The patient support surface 36 is modulated through two conceptually independent mechanisms. First, the patient support surface 36 is modulated through articulation, through mechanisms shown in FIGS. 4 and 9 or other conventional bed articulation mechanisms, of various sections of the multi-sectioned base platform 90. Second, the patient support surface 36 is further modulated, in a quite novel fashion, by movement of a plurality of independently movable points, vertices, or segments of the adjustable patient support framework 95. These independently movable points, vertices, or segments are oriented at or near the periphery 81 (FIG. 44) of the patient support surface 36.

Figure 12:
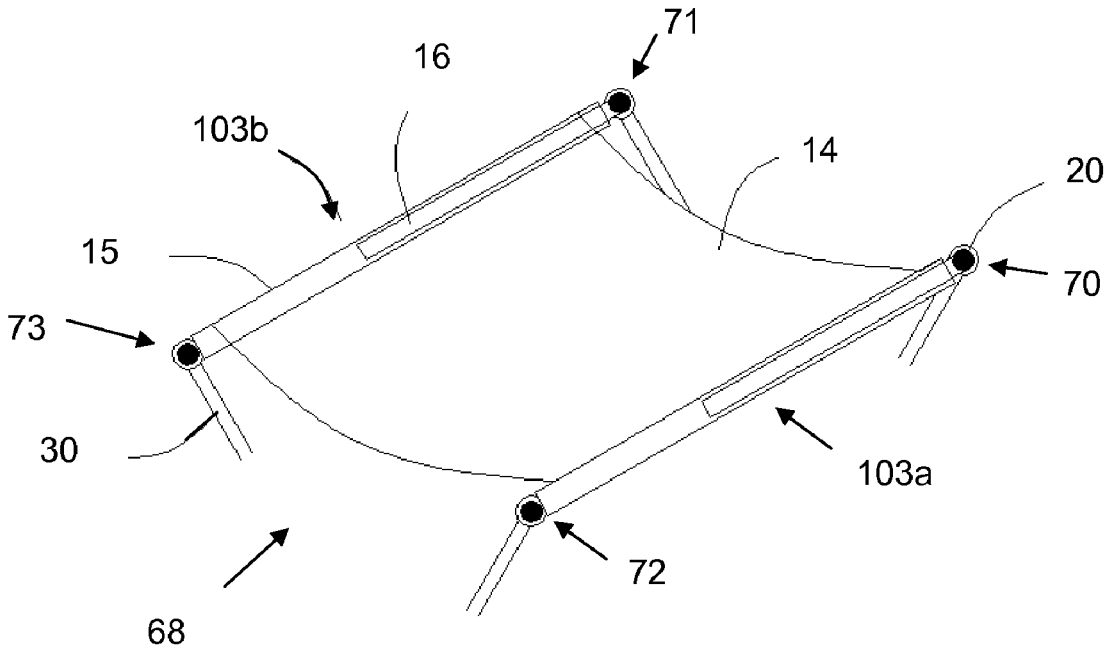
FIG. 12 illustrates the adjustable torso support litter that is also depicted in FIG. 2.
Figure 13:
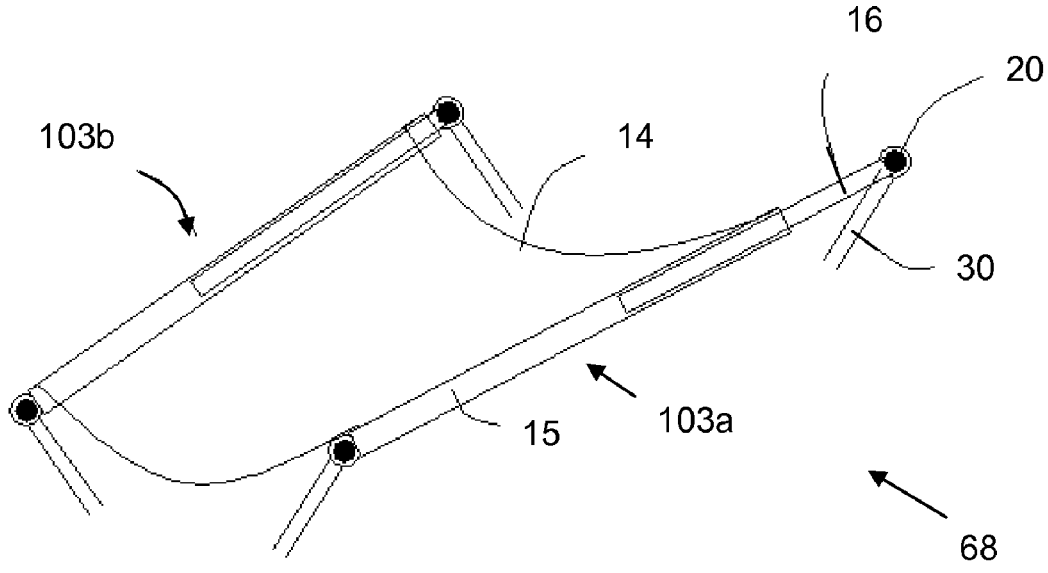
FIG. 13 further illustrates the adjustable torso support litter of FIG. 12, in a different orientation.

FIGS. 12 and 13 illustrate an embodiment of the adjustable torso support litter 68 that comprises four independently movable points or vertices: a superior right side vertex 70, a superior left side vertex 71, an inferior right side vertex 72, and an inferior left side vertex 73. The superior vertices 70, 71 are closer to the head end 36*a* than the inferior vertices 72, 73. Movement of each of these vertices 70-73 is accomplished by operation of an independently controllable actuator assembly 11 (FIG. 14), which is coupled by a movable arm 30 to, and operable to independently raise, its respective vertex 70, 71, 72, or 73. Each actuator assembly 11 is operable to independently raise its respective vertex 70, 71, 72, or 73 relative to the other vertices.

Figure 44:
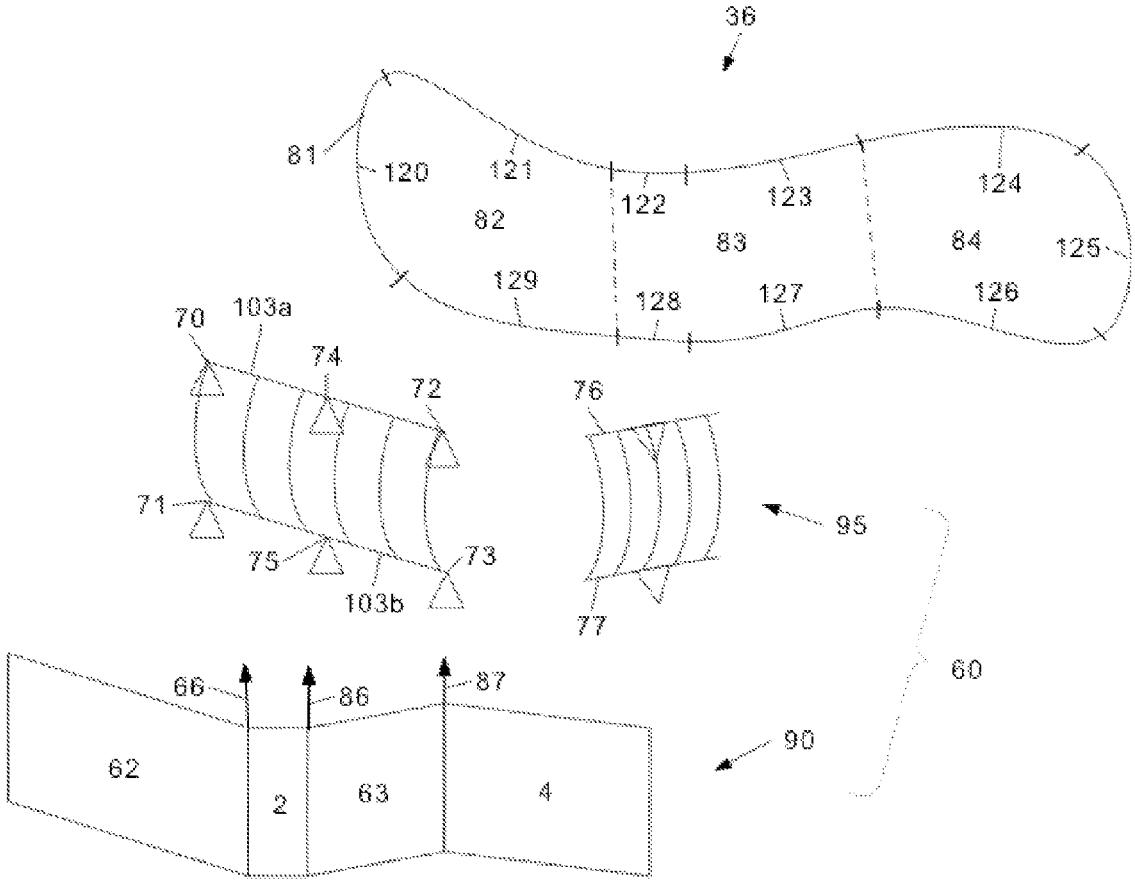
FIG. 44 is an exploded-view schematic diagram illustrating the relationship between the articulating multisectioned base platform of the patient support platform, the adjustable patient support framework of the patient support platform, and the patient support surface, which is modulated by movement of points and segments oriented at or near its periphery.

Each of the vertices 70-73 comprises a pivotal joint 20 that connects its respective movable arm 30 (FIG. 14) to one end of a side support bar 103. More particularly, a right side support bar 103*a* connects the superior right side vertex 70 to the inferior right side vertex 72, and a left side support bar 103*b* connects the superior left side vertex 71 to the inferior left side vertex 73. A flexible mattress-supporting foundation 14—which provides support to the corresponding portion (i.e., torso area) of the patient support surface 36—is mounted to the side support bars 103*a* and 103*b*. As seen in FIG. 44, the inferior right and left side vertices 72 and 73 are oriented near the intersection between the upper-body supporting section 82 and the midsection 83 of the patient support surface 36.

To increase the range of motion of each of the vertices 70-73, and to reduce bending forces and torsional loads on the movable arms 30, the right and left side support bars 103*a* and 103*b* preferably have adjustable lengths. In a preferred embodiment, this is accomplished by providing that each right and left side support bar 103*a* and 103*b* comprise an inner rod 16 that telescopes or slides within an outer rod 15 (FIG. 12).

Figure 14:
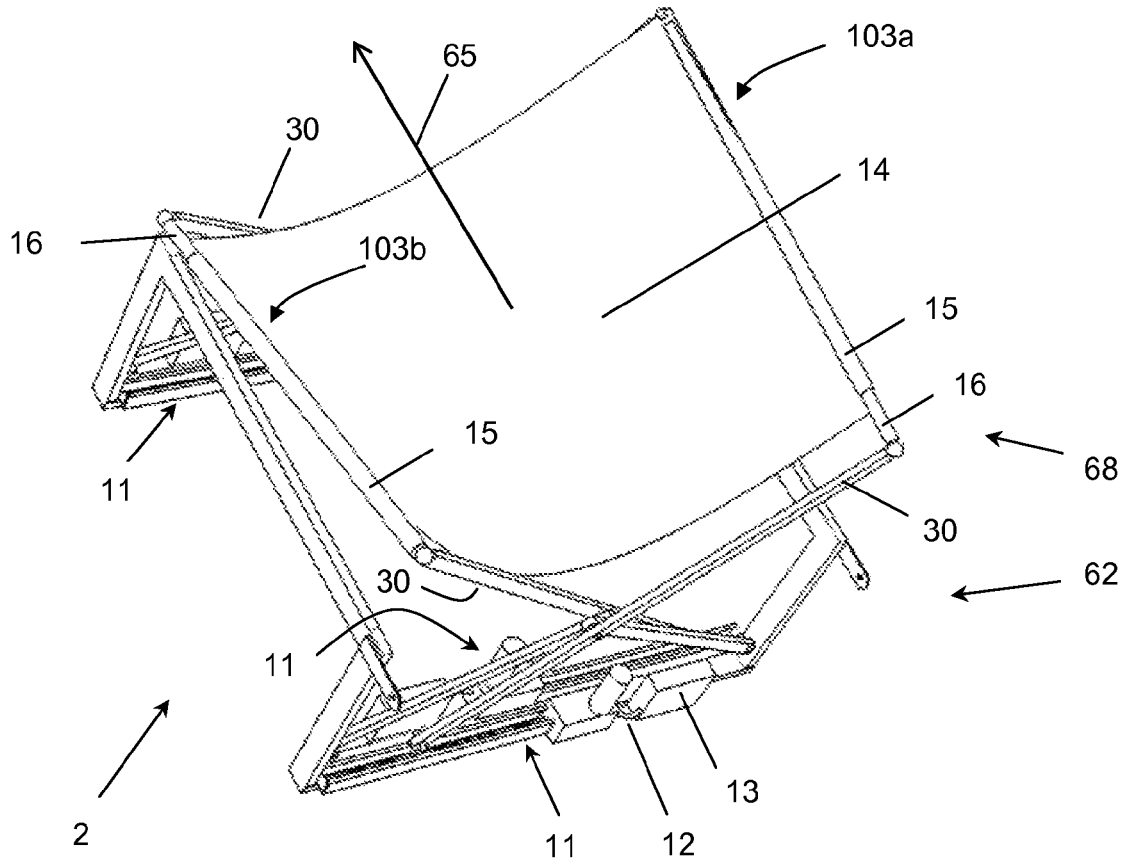
FIG. 14 illustrates a perspective view of the torso support structure that is also depicted in FIG. 7.

FIG. 14 illustrates a perspective view of the torso support structure 2. Four movable arms 30 are attached to the ends of the side support bars 103. Independently controllable actuator assemblies 11 mounted on the torso support structure 2 are drivingly connected to the moveable arms 30 and provide means to move the side support bars 103 in both vertical and lateral directions to induce, if desired, a rotational movement of the patient about a longitudinal axis 65 of the torso support structure 2.

Figure 2:
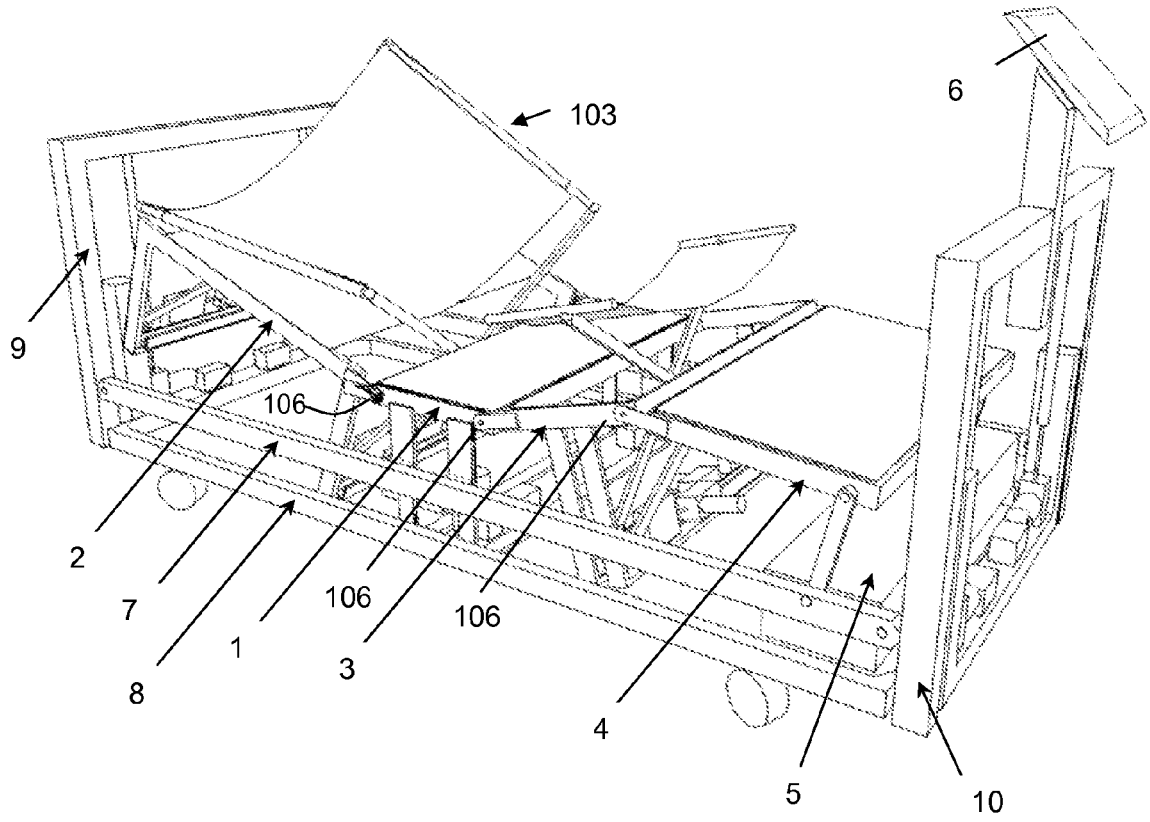
FIG. 2 illustrates a perspective view of the adjustable bed of FIG. 1 with the overlying patient support surface removed.
Figure 3:
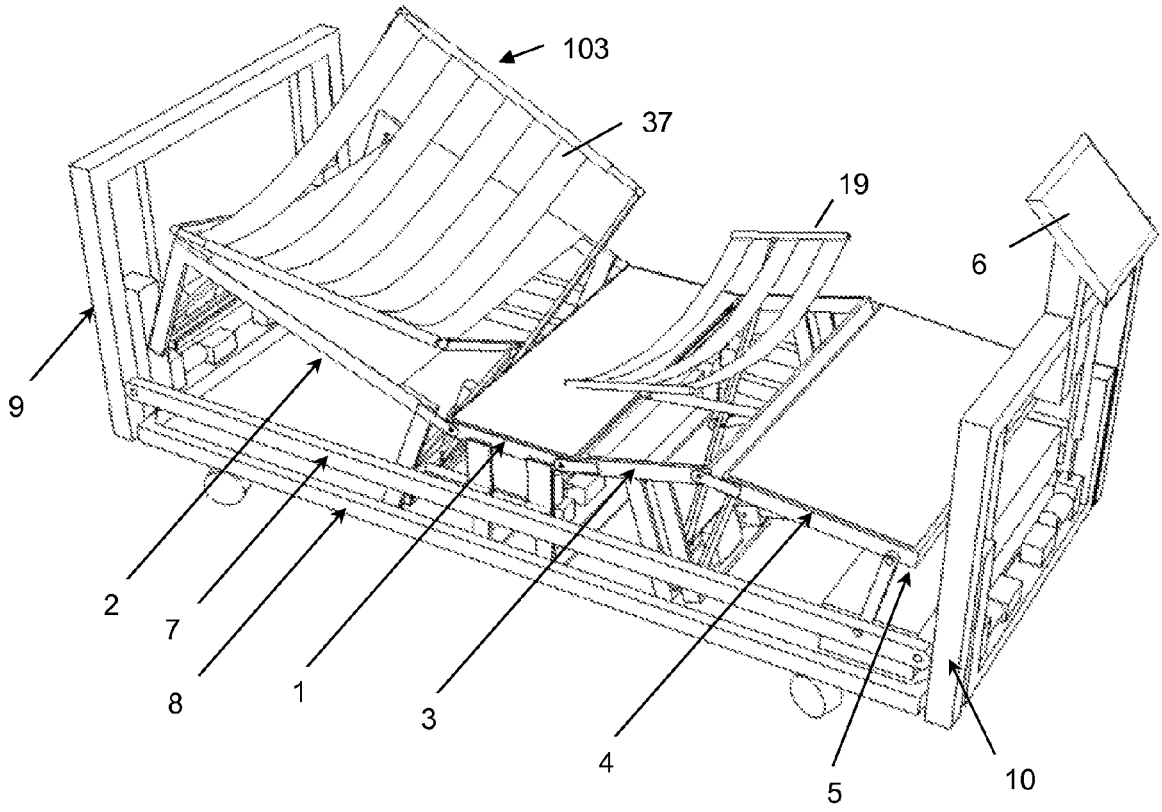
FIG. 3 illustrates a perspective view of an alternative embodiment of the adjustable bed of FIG. 1 with the overlying patient support surface removed, and depicting a mattress-supporting foundation consisting of bands instead of flexible sheets.
Figure 6:
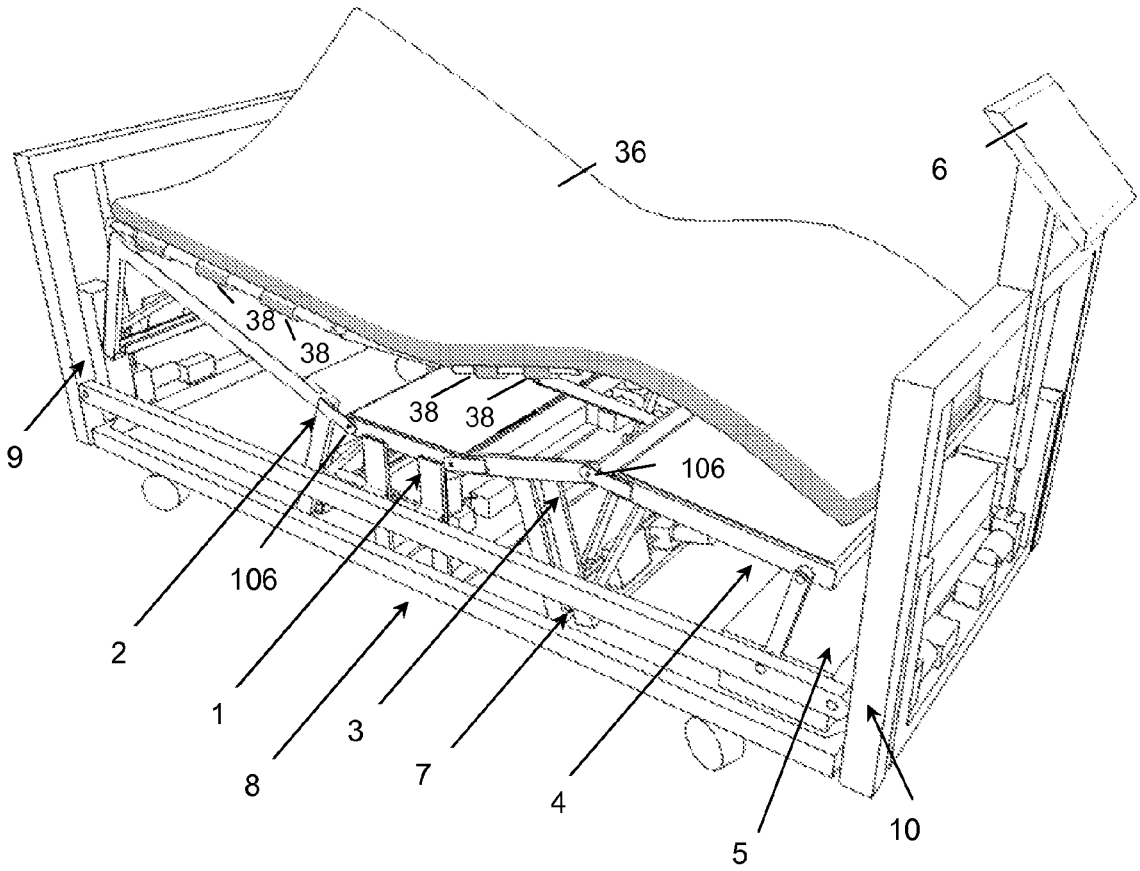
FIG. 6 illustrates a perspective view of an alternative embodiment of the adjustable bed, with clamps for bonding the patient support surface to support bars on the patient support structure.
Figure 8A:
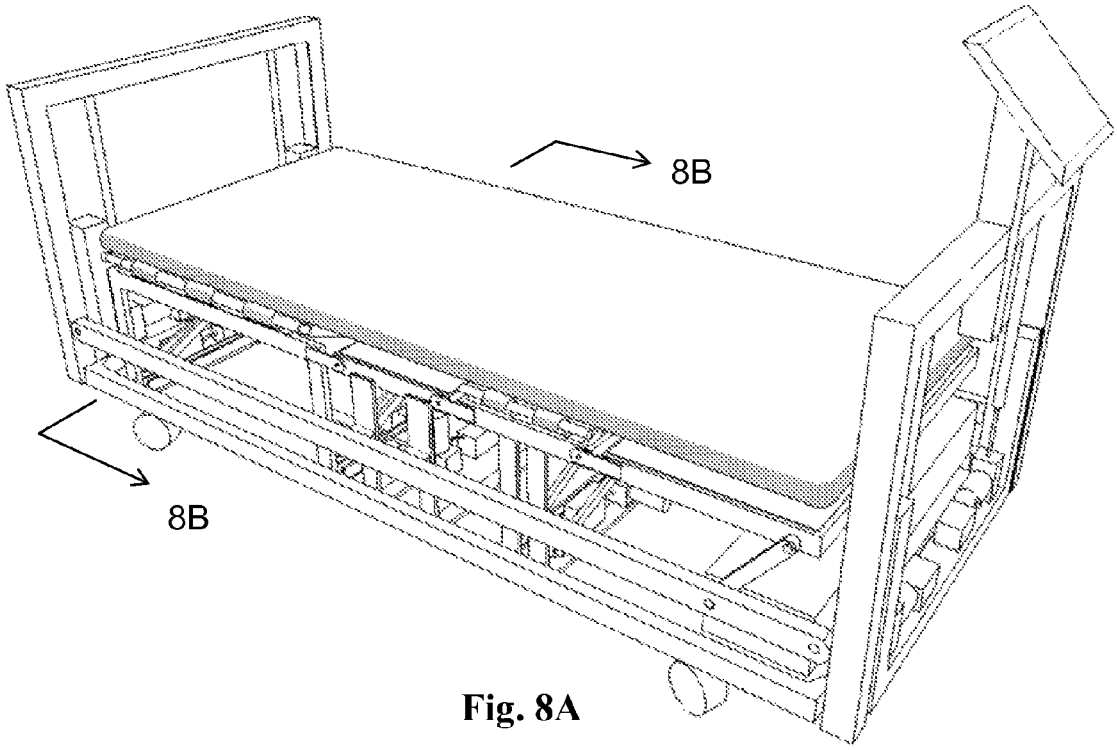
FIG. 8A illustrates a perspective view of the adjustable bed of FIG. 6 in the horizontal position.
Figure 8B:
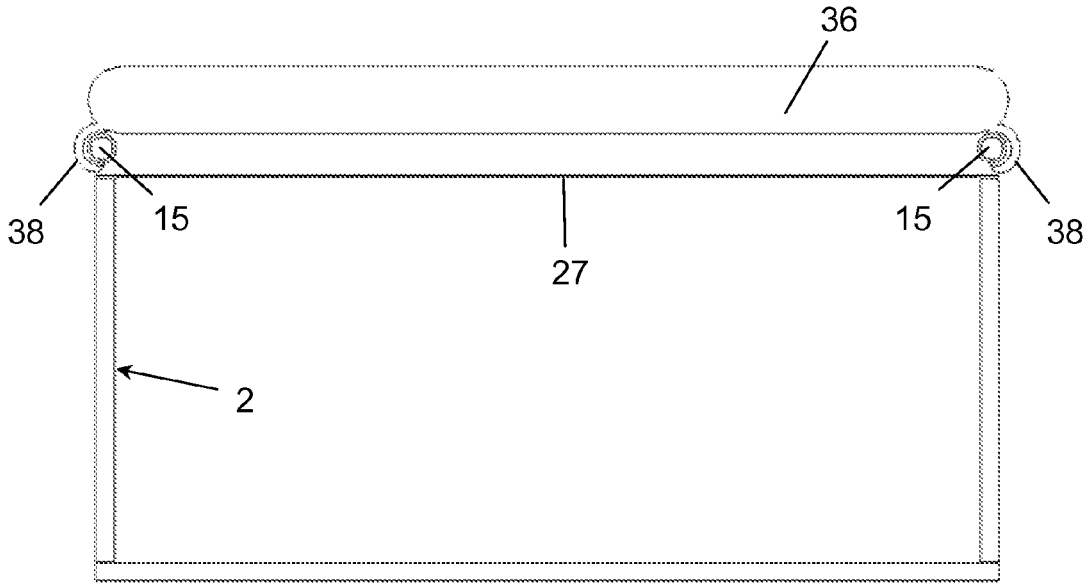
FIG. 8B illustrates a sectional view of the adjustable bed of FIG. 8A.

FIGS. 2, 3, 6, 8A, 8B, and 14 illustrate different embodiments of the flexible mattress-supporting foundation or hammock 14. In FIGS. 2 and 14, the flexible mattress-supporting foundation 14 consists essentially of a sheet mounted on the right and left side support bars 103*a* and 103*b* and stretched between the four vertices 70, 71, 72, and 73. In FIG. 3, the flexible mattress-supporting foundation 14 comprises a plurality of straps, bands or belts 37 (preferably slightly elastic) affixed to and bridging the side support bars 103*a* and 103*b*. In FIGS. 6, 8A and 8B, the flexible mattress-supporting foundation 14 in incorporated within the wrapping of the patient support surface 36, and secured to the side support bars 103 through straps or clamps 38. The flexible mattress-supporting foundation 14 may also comprise a net or any other suitable material.

Figure 7:
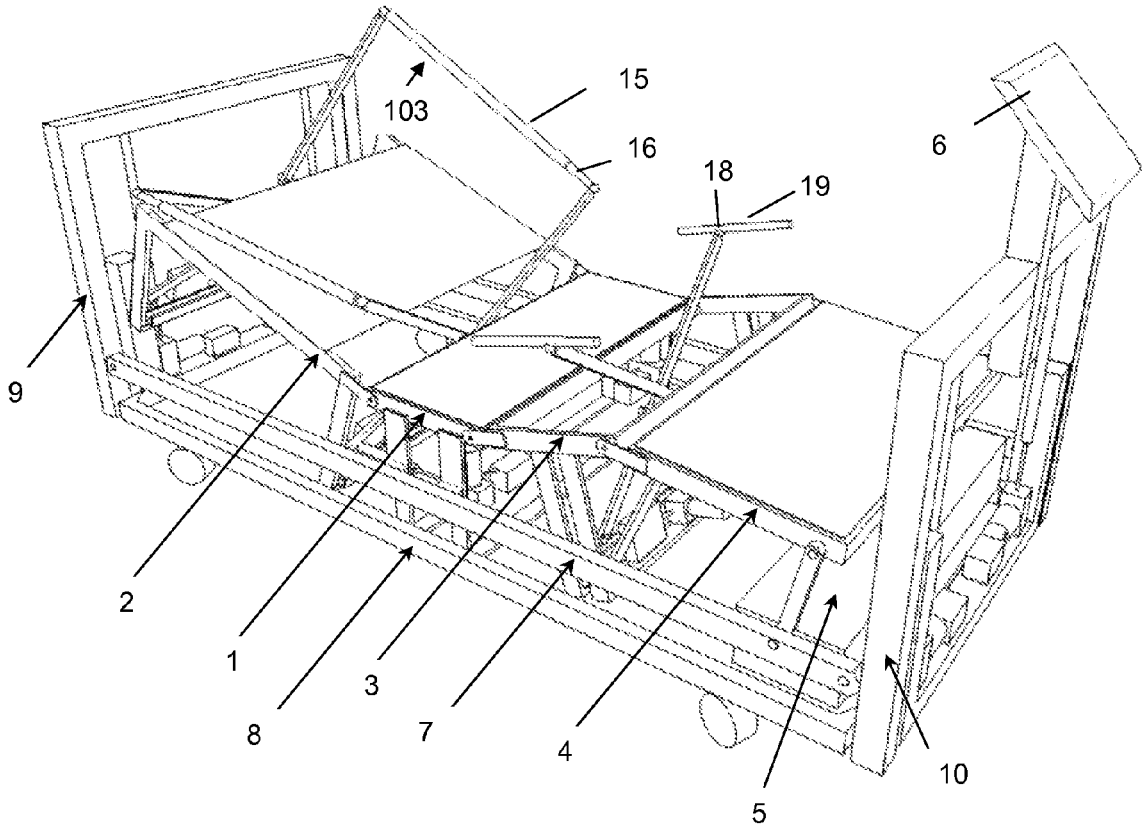
FIG. 7 illustrates a perspective view of the adjustable bed of claim 1, with both the patient support surface and the mattress-supporting foundation removed.
Figure 15:
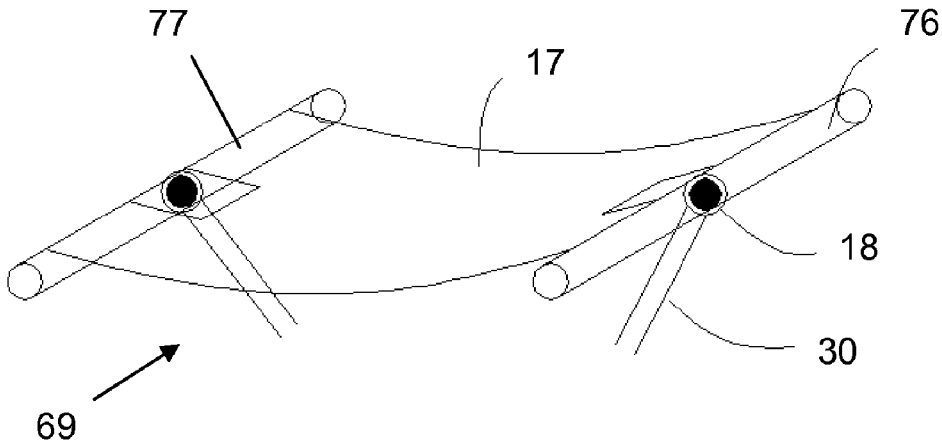
FIG. 15 illustrates a perspective view of the adjustable hip support litter that is also depicted in FIG. 2.
Figure 16:
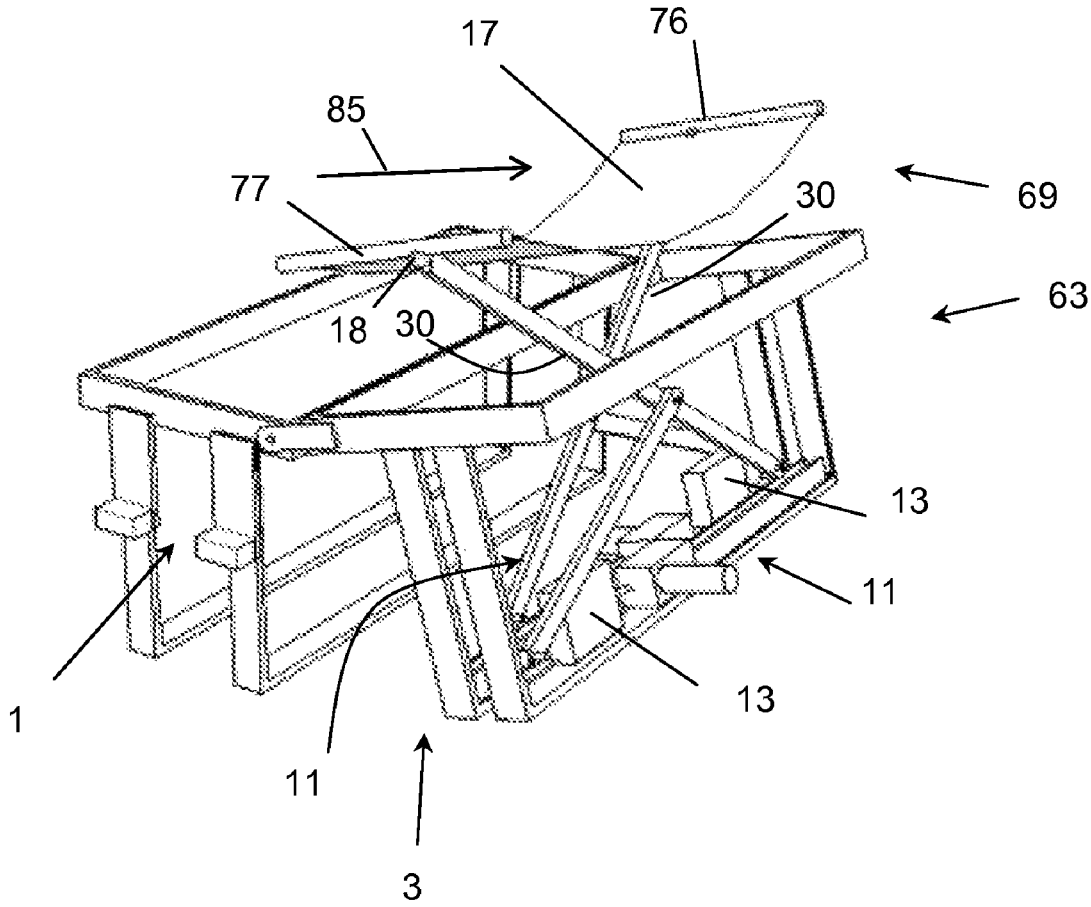
FIG. 16 illustrates a perspective view of the hip support structure and the central support structure of FIG. 2.

FIGS. 15 and 16 illustrate an embodiment of the adjustable hip and upper-leg support litter 69 that comprises two independently movable segments—a right side support bar 76 and a left side support bar 77. Side support bars 76 and 77 are also illustrated in FIGS. 3 and 7 by reference number 19. Movement of each of these bars 76 and 77 is accomplished by operation of an independently controllable actuator 11 (FIG. 16), which is coupled by a movable arm 30 to, and operable to independently raise, its respective side support bar 76 or 77. Each movable arm 30 is coupled to the center of the corresponding side support bar 76 or 77 through a pivotal joint 18. The position of pivotal joints 18 and the adopted position of hip and upper legs of the patient define the orientation of the side support bars 76 and 77. In this way, an ergonomic and physiological capacity is achieved. As with FIGS. 12-14, a flexible mattress-supporting foundation or hammock 17 is mounted on and between side support bars 76 and 77. And like the flexible mattress-supporting foundation or hammock 14, the flexible mattress-supporting foundation or hammock 17 may comprise a sheet, straps, netting, or any other suitable material.

FIG. 16 illustrates a perspective view of the hip support structure 3 and central support structure 1. The independently controllable actuators 11 mounted on the hip support structure 3, and drivingly connected to the moveable arms 30, provide a means to move the side support bars 76 and 77 in both vertical and lateral directions in such a way as to induce rotational movement of the a patient's hip and upper legs about a longitudinal axis 85.

Figure 4:
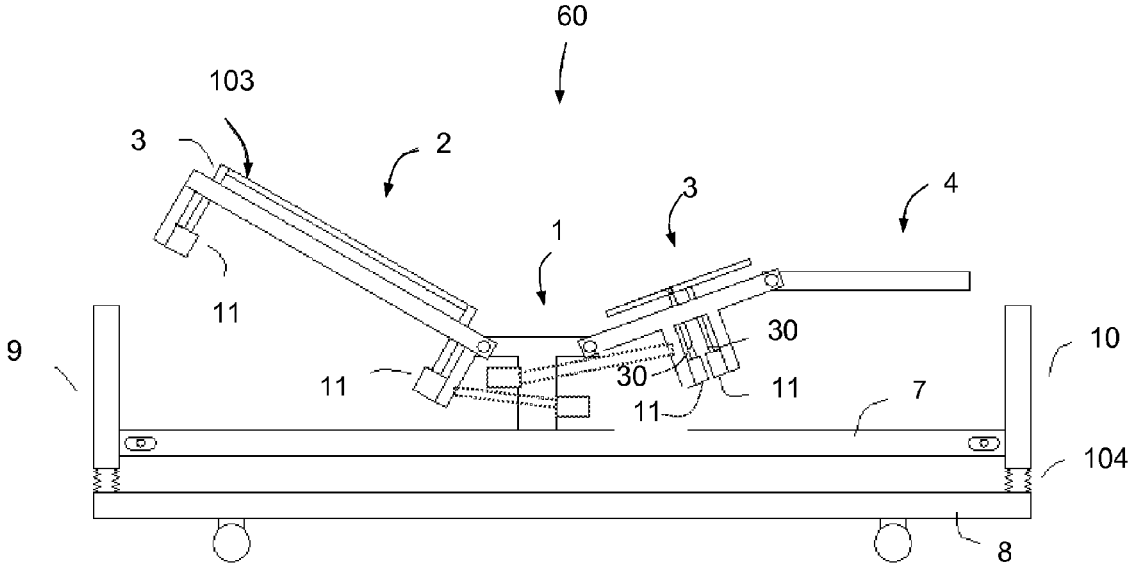
FIG. 4 illustrates a side view of the patient support structure and upper and lower chasses of the adjustable bed of FIG. 1.
Figure 5A:
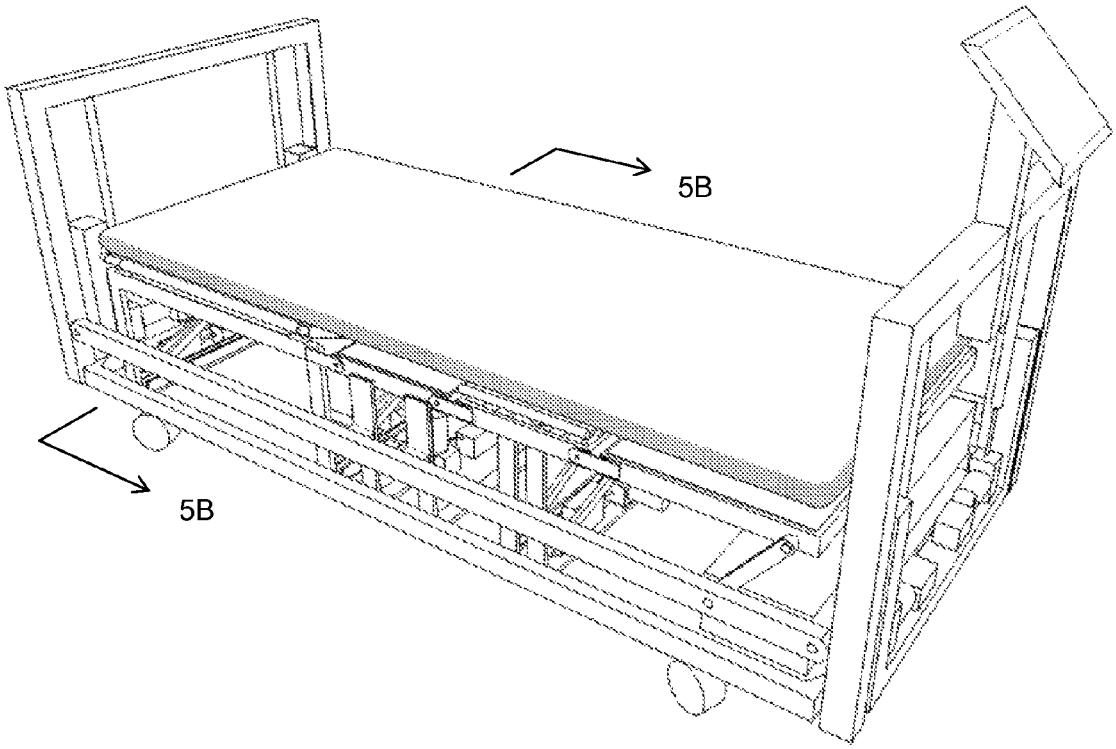
FIG. 5A illustrates a perspective view of the adjustable bed of FIG. 1 with the patient support surface in flat, unmodulated, horizontal position.
Figure 5B:
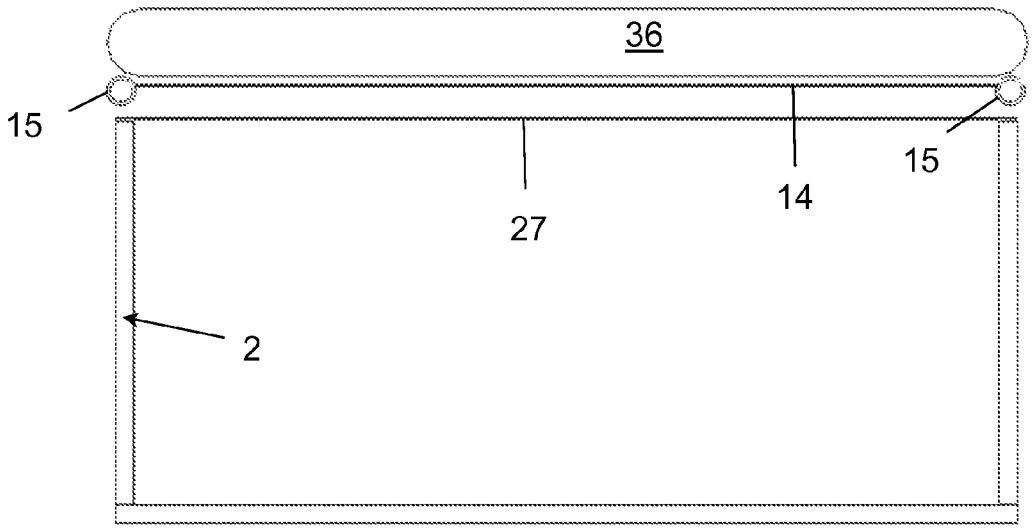
FIG. 5B illustrates a sectional view of the adjustable bed of FIG. 5A.

FIG. 4 illustrates a side view of the adjustable bed 100 of FIG. 1 having the torso support structure 2 and the hip support structure 3 rotated about the transversal axis of the patient. Two of the four independently controllable actuator assemblies 11, drivingly connected to the movable arms 30 and mounted on the torso support structure 2, are shown. Also shown are two independently controllable actuator assemblies 11, drivingly connected to the two movable arms 30 and mounted on the hip support structure 3.

Figure 17:
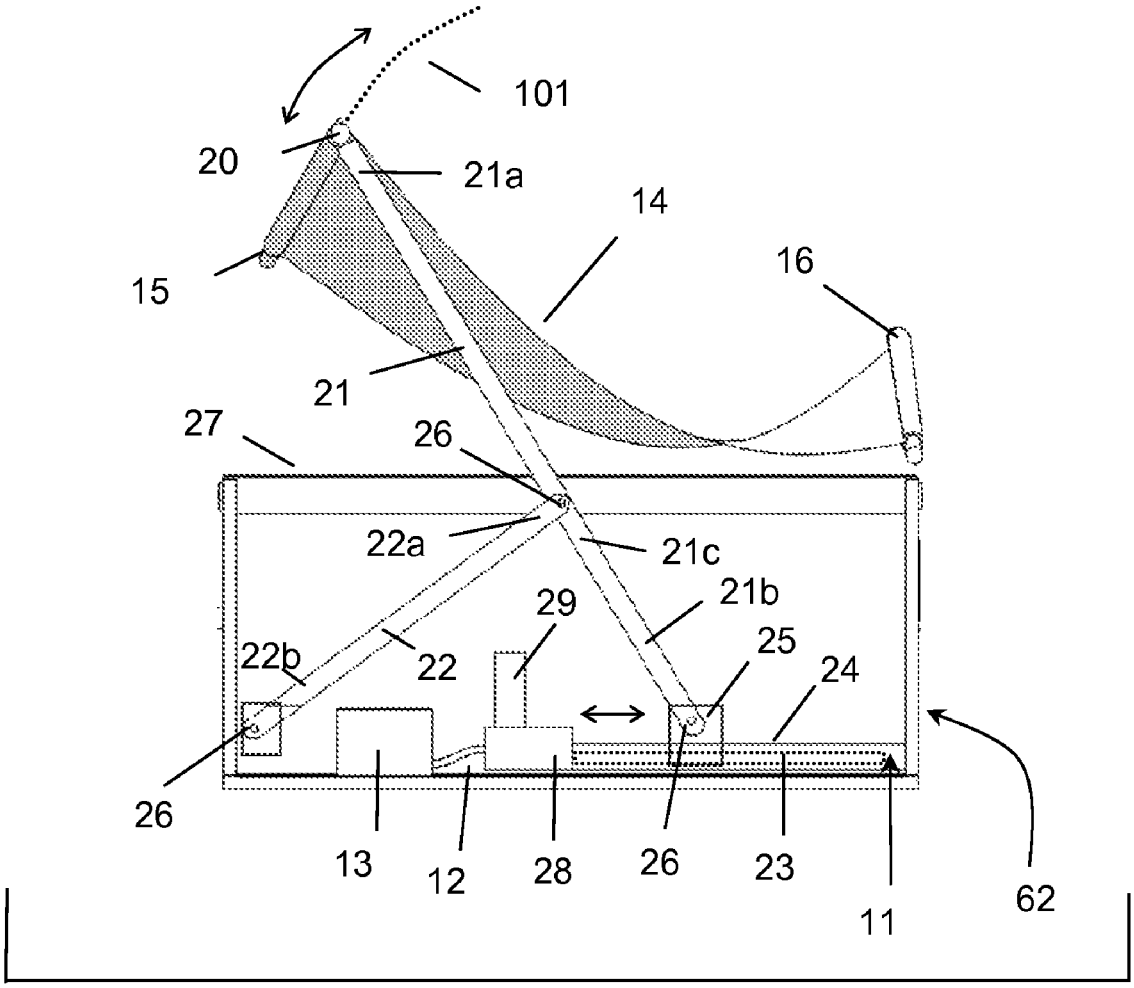
FIG. 17 illustrates a preferred embodiment of a mechanical actuator assembly to manipulate one of the vertices of the torso support structure.

C. Independently Controllable Actuator Assemblies for the Torso and Hip Support Litters FIGS. 17-23 illustrate various embodiments of independently controllable actuator assemblies 11 operable to move the vertices 70-73 of the torso support litter 68. FIG. 17 illustrates a mechanical lateral actuator 11 drivingly connected to a principal arm 21. The mechanical lateral actuator 11 comprises a sliding element 25 movable within a sliding guide 24. The inferior (i.e., lower) end 21*b* of the principal arm 21 is connected to the sliding element 25 via a hinge 26. The superior (i.e., upper) end 21*a* of the principal arm 21 is connected to the pivotal joint 20 that forms one of the torso support section vertices 70-73.

A secondary arm 22, having superior and inferior ends 22*a* and 22*b*, respectively, provides support to the principal arm 21. The superior end 22*a* of the secondary arm 22 is connected a midsection 21*c* of the principal arm 21 via a hinge 26. The inferior end 22*b* of the secondary arm 22 is attached to the torso support base structure 62 via another hinge 26. A screw 23 driven by an electric motor 29 and a mechanical reducer 28 causes the sliding element 25 to advance or retreat within the sliding guide 24. The motor 29 is operated by a peripheral control unit 13 to which the motor is connected via cable 12.

Operation of the mechanical lateral actuator 11 causes the respective vertex 70, 71, 72, or 73 to travel along a characteristic curve or path 101. This characteristic curve or path 101 is defined, in part, by the position of hinge 26 joining the secondary arm 22 to the principal arm 21.

Figure 18:
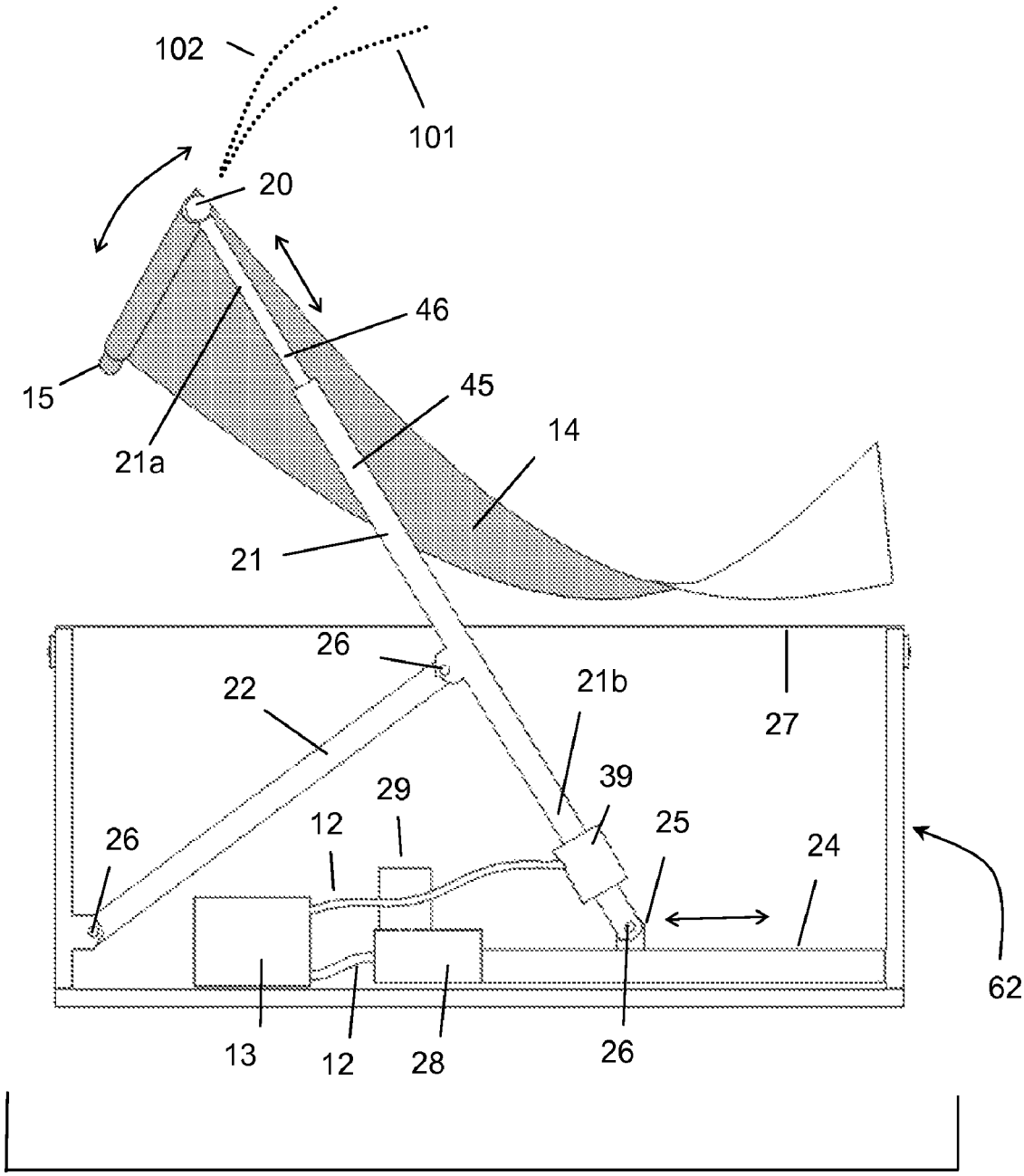
FIG. 18 illustrates a sectional rear plan view of another embodiment of a mechanical actuator assembly, incorporating a telescopic arm, to manipulate one of the vertices of the torso support structure.

FIG. 18 illustrates an alternative independently controllable actuator assembly, similar to the assembly depicted in FIG. 17 but having a telescoping principal arm 21 driven by an additional linear mechanical actuator 39. The additional linear mechanical actuator 39 causes an inner rod 46 of the principal arm 21 to telescope within a coaxial outer rod 45 of the principal arm 21. This facilitates extra displacement of joint 20, thereby increasing the range of motion of the assembly. In this embodiment, operation of the mechanical lateral actuator 11 together with linear mechanical actuator 39 causes the respective vertex 70, 71, 72, or 73 to travel along one of multiple characteristic curves or paths 101, 102, etc.

Figure 19A:
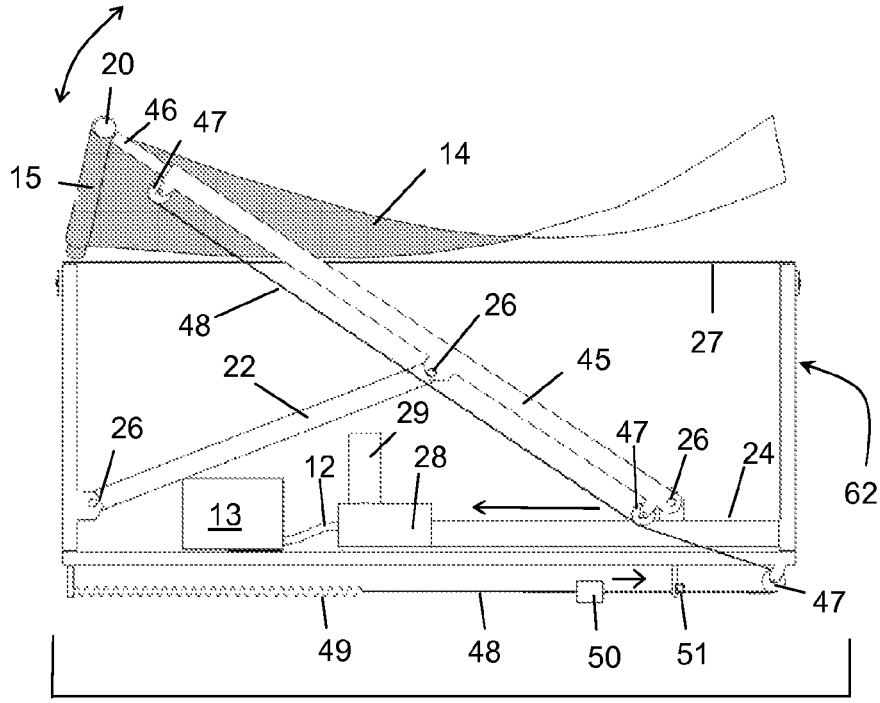
FIG. 19A illustrates yet another embodiment of a mechanical actuator assembly, incorporating a telescopic arm operated by a spring and steel cord, to manipulate one of the vertices of the torso support structure.
Figure 19B:
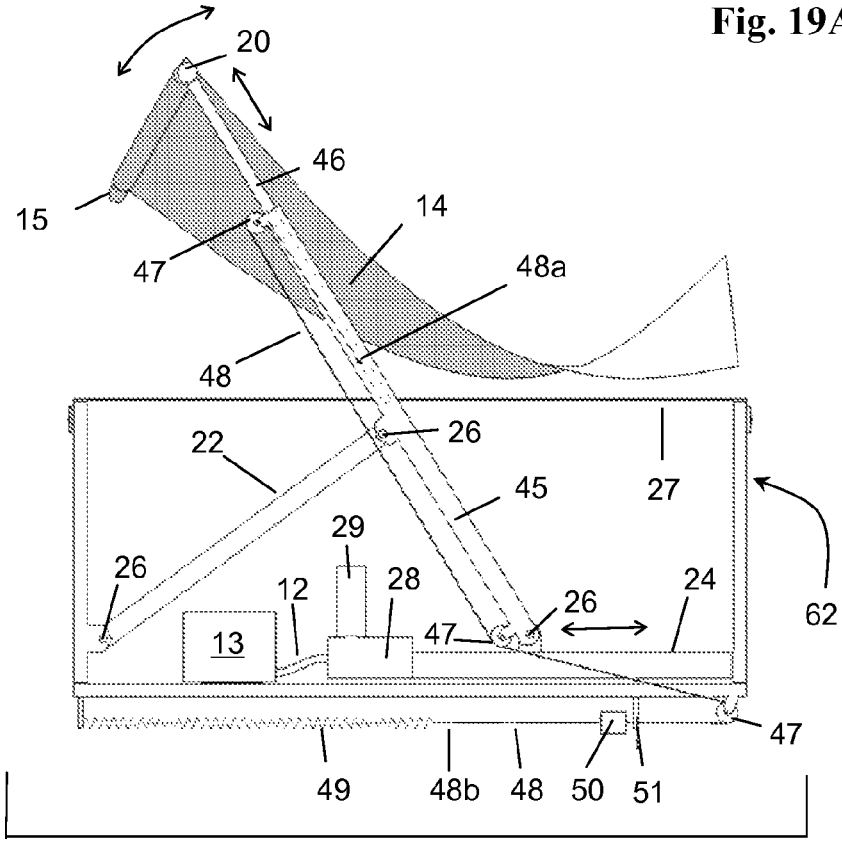
FIG. 19B illustrates the embodiment of FIG. 19A in the upper position.

FIGS. 19A and 19B illustrate another independently controllable actuator assembly. Like FIG. 18, this alternative assembly has a telescoping principal arm 21. But in FIGS. 19A and 19B, a steel cord 48 mounted on several pulleys 47, and tensioned by a spring 49, drives the sliding action of the telescoping inner rod 46. One end 48*a* of the steel cord 48 is connected to the telescoping inner rod 46. The opposite end 48*b* of the steel cord 48 is connected to the spring 49. Operation of the mechanical lateral actuator 11 to raise the principal arm 21 increases the tension on the steel cord 48. This causes the spring 49 to stretch and the telescoping inner rod 46 to extend.

To further regulate the characteristic curve 101 about which the respective vertex 70, 71, 72, or 73 moves, a register 50 is secured to the steel cord 48, and the steel cord is threaded through a mechanical limit 51. When the register 50 meets the mechanical limit, further operation of the mechanical lateral actuator 11 to raise the principal arm 21 causes the steel cord 48 to exert traction action on the telescoping inner rod 46, thereby raising it. As the principal arm 21 is lowered, tension on the spring 49 is relieved, and the telescoping inner rod 46 retracts back into the coaxial outer rod 45. The position of the register 50 can be changed for regulation of desired characteristic curve.

In FIG. 19A shows the mechanism in a position in which the register 50 did not reach the mechanical limit 51. Accordingly, the telescoping inner arm 46 is fully retracted within the telescopic principal arm 45. In FIG. 19B shows the mechanism in a position after the register 50 has reached the mechanical limit 51. Here, the telescoping inner rod 46 is in an extended position. As result of this action, the joint 20 is moved higher than it would otherwise be. This alternative assembly increases the range of motion of joint 20 in a more economical manner than shown in FIG. 18, using only one actuator.

Figure 20:
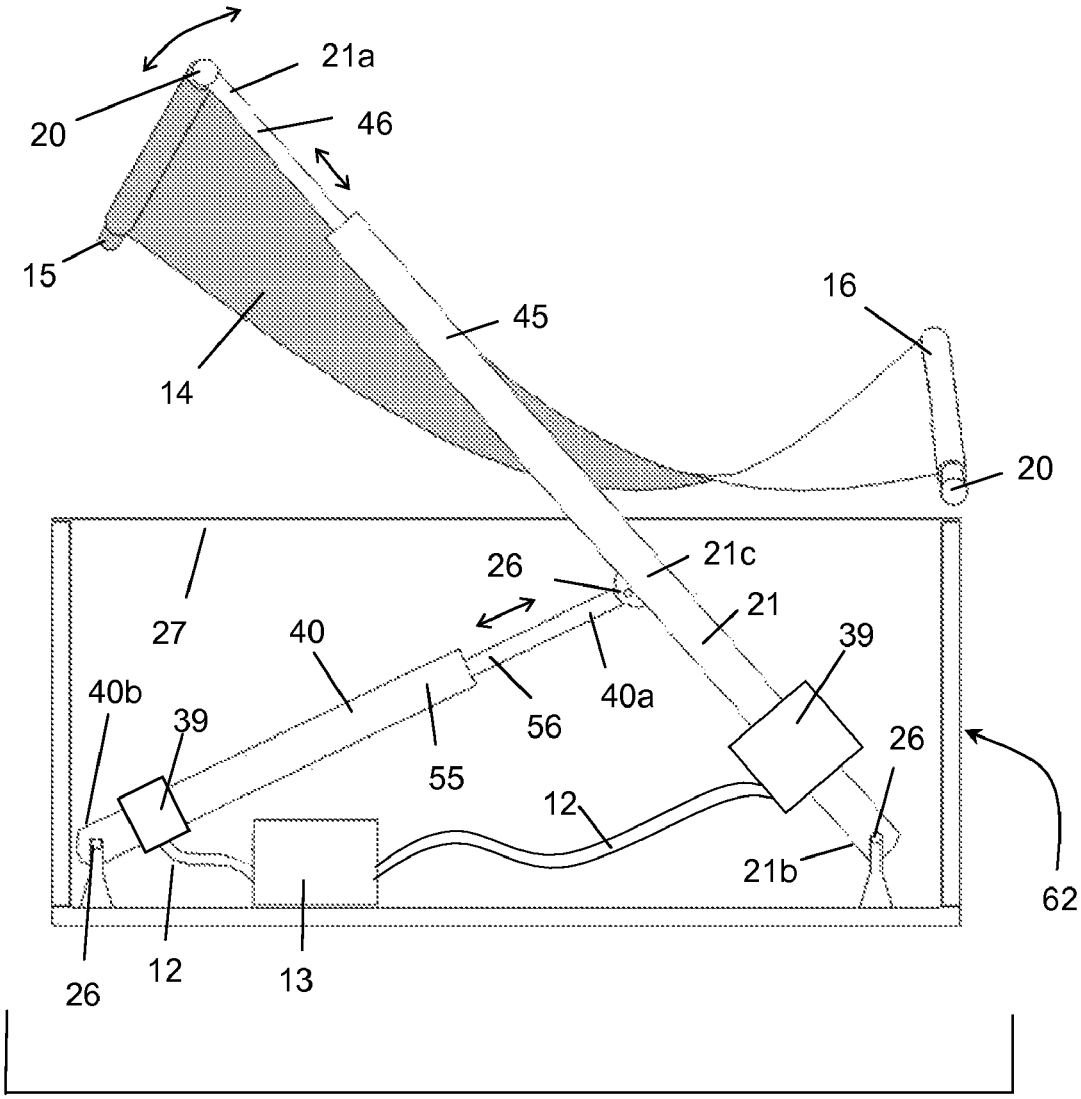
FIG. 20 illustrates a sectional rear plan view of yet another embodiment of a mechanical actuator assembly, utilizing two linear actuators driving telescoping principal and secondary arms, to manipulate one of the vertices of the torso support structure.

FIG. 20 illustrates yet another alternative independently controllable actuator assembly. This embodiment comprises a telescoping principal arm 21 and a telescoping secondary arm 40, each driven by a linear mechanical actuator 39. Moreover, the two linear mechanical actuators 39 in this embodiment substitute for the mechanical lateral actuator 11 shown in FIG. 17. The telescoping principal arm 21 comprises an inner rod 46, driven by a linear actuator 39, the telescopes within a coaxial outer rod 45. Likewise, the telescoping secondary arm 40 comprises an inner rod 56, also driven by a linear actuator 39, that telescopes within an outer rod 55. The inferior (i.e., lower) end 21*b* of the principal arm 21 is hingedly linked to the torso support base structure 62, while the superior (i.e., upper) end 21*a* of the principal arm 21 is joined to one of the torso support section vertices 70-73. The inferior end 40*b* of the telescoping secondary arm 40 is hingedly linked to the torso support base structure 62, while the superior end 40*a* of the telescoping secondary arm 40 is hingedly joined to a midsection 21*c* of the principal telescoping arm 21. This alternative generates a different set of characteristic curves than those obtained by the mechanism shown in FIG. 18.

Figure 21:
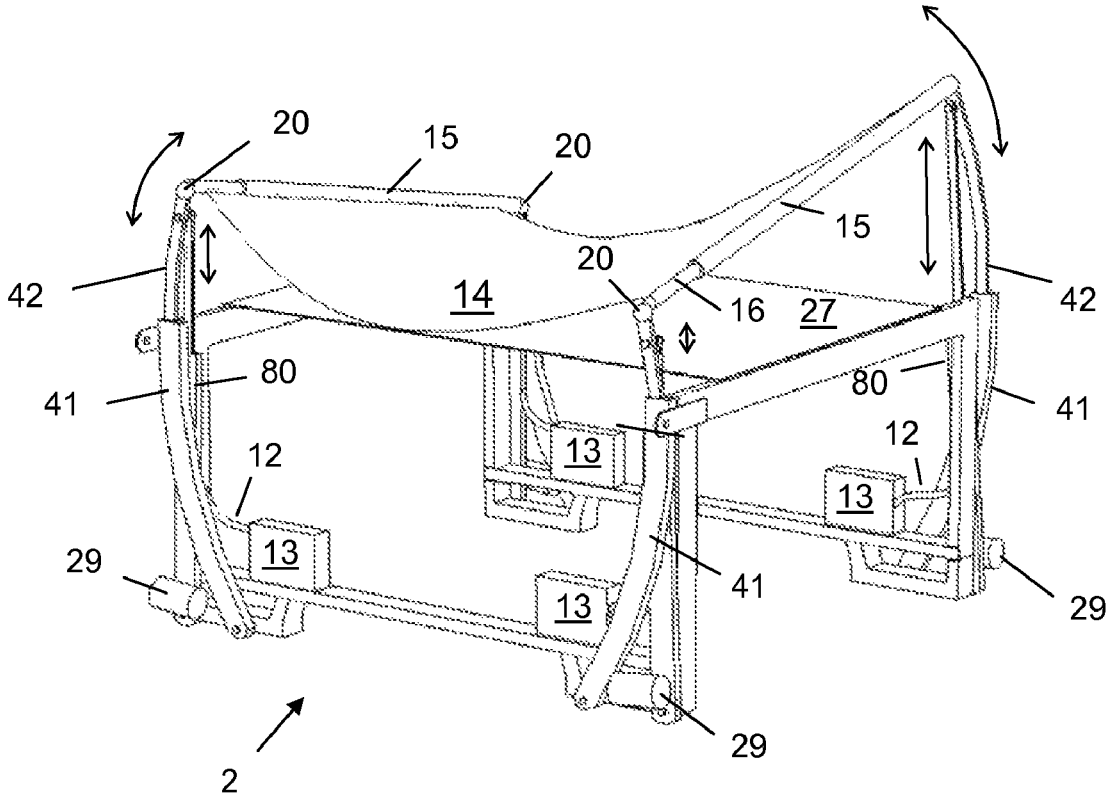
FIG. 21 illustrates a perspective view of a torso support structure using a curved telescoping arm and actuator assembly to manipulate the vertices of the torso support structure.
Figure 22:
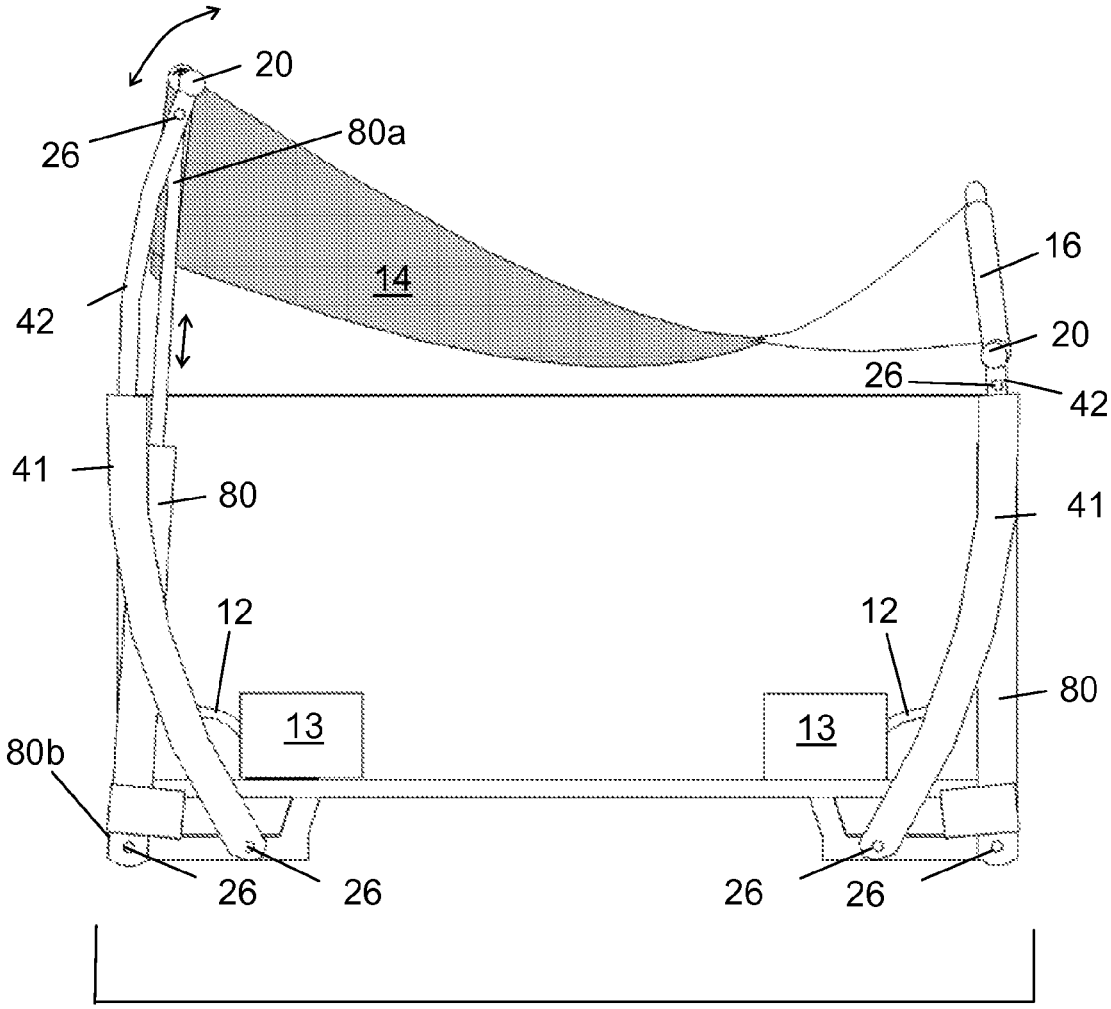
FIG. 22 illustrates a partial rear plan view of curved telescoping arm and actuator assembly of FIG. 21.

FIGS. 21 and 22 illustrate yet another independently controllable actuator assembly. Here, each independently controllable actuator assembly comprises a curved arm 42, sliding within a curved guide 41, driven by a linear actuator 80 mounted on one end 80*b* by a hinge 26 to the torso support base structure 62 and on an opposite end 80*a* by another hinge 26 to the curved arm 42. The linear actuator 80 is operable to move the curved arm 42 between retracted and extended positions, thereby displacing the associated joint 20. The curvature of the curved arm 42 and curved guide 41 define the characteristic curve or path 101 over which the joint 20 travels.

Figure 23:
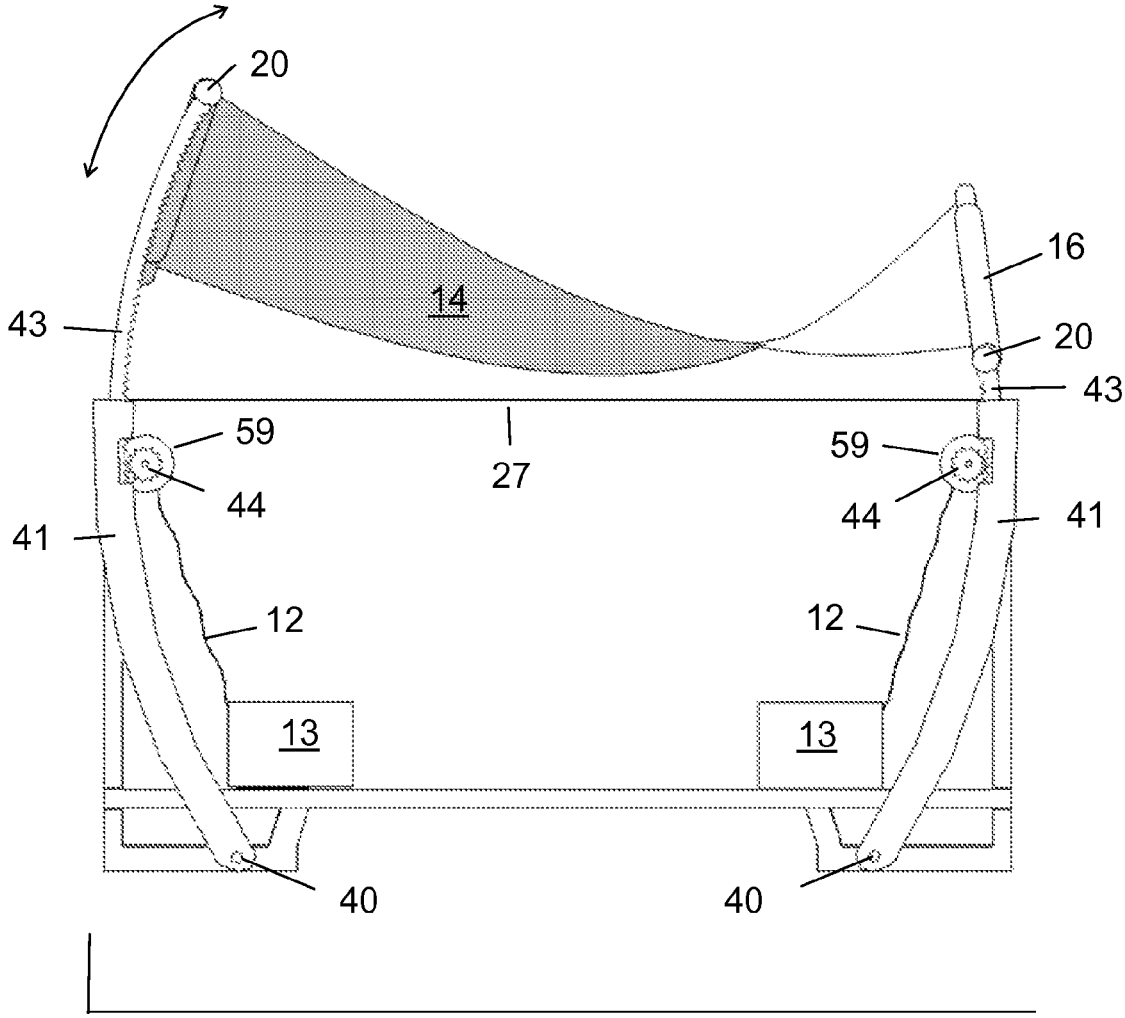
FIG. 23 illustrates a partial rear plan view of an alternative embodiment of the curved telescoping arm and actuator assembly of FIGS. 21 and 22, employing sliding arms with gears.

FIG. 23 illustrates a modification of the independently controllable actuator assembly depicted in FIGS. 21 and 22. In FIG. 23, a curved arm 43 with gear teeth disposed along its concave surface replaces the curved arm 22 of FIGS. 21 and 22. Moreover, a rotary actuator 59 with gear teeth adapted to mesh with the gear teeth of the curved arm 43 replaces the linear actuator 80 of FIGS. 21 and 22. The rotary actuator 59, which is affixed to the outside of the curved guide 41, is operable to drive the curved arm 43 between retracted and extended positions. This alternative has the advantage of a reduced number of parts.

Because the independently controllable actuator assemblies of FIGS. 17-23 are mounted on a common bed frame section, namely the articulatable torso support base structure 62, it will be observed that in the preferred embodiment, each of the actuator assemblies depicted therein comprises a plurality of moving parts whose movements, relative to the torso support base structure 62, are confined to a transverse plane perpendicular to the longitudinal axis 65 (FIG. 14) of the torso support base structure 62. Moreover, in FIG. 17, it will be observed that the sliding guide 24 confines the movement of the sliding element 25 to a horizontal linear segment within the transverse plane perpendicular to the longitudinal axis 65 of the torso support base structure 62.

Any of the independently controllable actuator assemblies depicted in FIGS. 17-23 for the torso support structure 2 can also be used for the hip support structure 3. Because these assemblies are sufficiently illustrated in FIGS. 17-23 with respect to the torso support structure 2, they are not separately depicted with equal detail with respect to the hip support structure 3.

Because the independently controllable actuator assemblies that are mounted on the articulatable hip support base structure 63 are also mounted on a common bed frame section, it will be observed that in the preferred embodiment, each such actuator assembly comprises a plurality of moving parts whose movements, relative to the hip support base structure 63, are confined to a transverse plane perpendicular to the longitudinal axis 85 (FIG. 16) of the hip support base structure 63.

D. Alternative Embodiment of FIGS. 24A and 24B

Figure 24A:
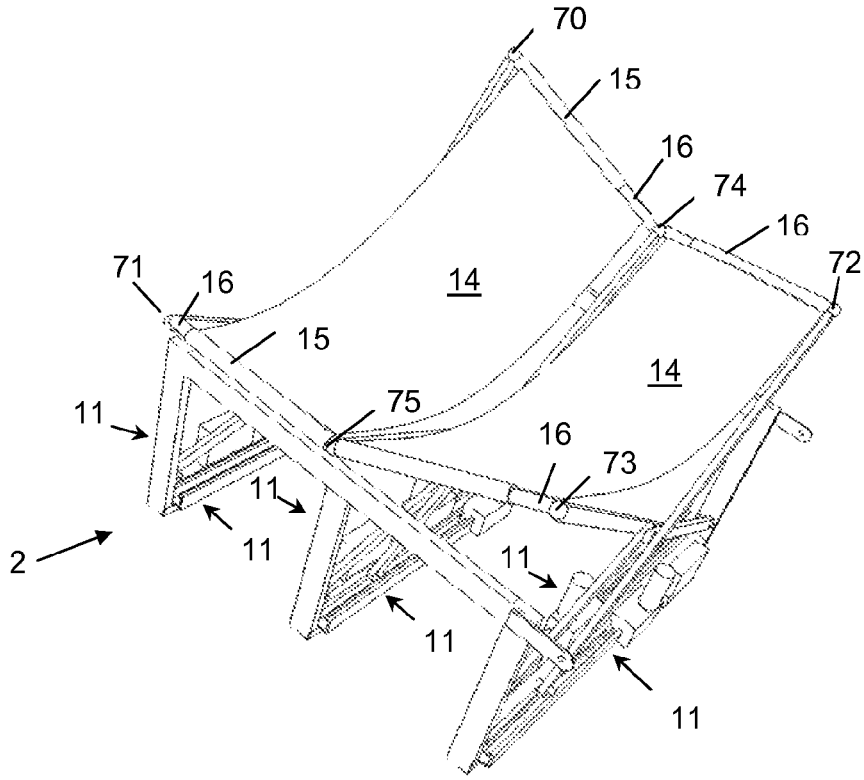
FIG. 24A illustrates a perspective view of another embodiment of a torso support structure that includes additional independently movable points or vertices of actuation.
Figure 24B:
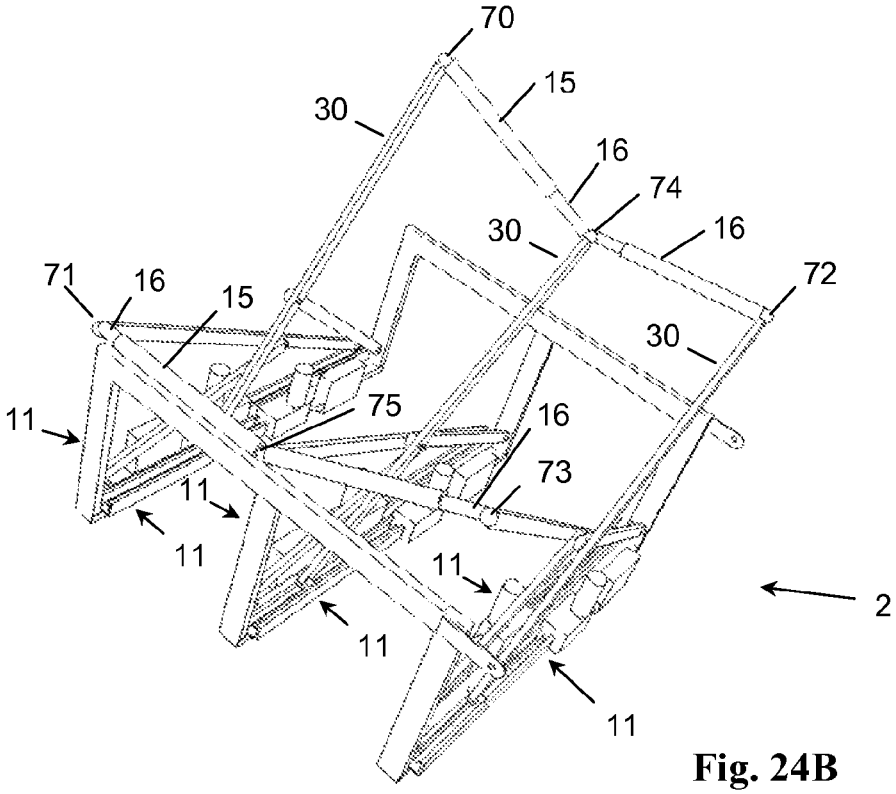
FIG. 24B illustrates FIG. 24A with the sheets removed for clarity.

FIGS. 24A and 24B illustrate a perspective view of a torso support structure 2 that incorporates two more independently movable points or vertices. In particular, the torso support structure 2 further comprises an intermediate right-side vertex 74 between the superior and inferior right side vertices 70 and 72 and an intermediate left side vertex 75 between the superior and inferior left side vertices 71 and 73. Each vertex 70-75 is defined by a joint 20. And each joint 20 is independently actuated by its own corresponding controllable actuator assembly 11. Two of these independently controllable actuator assemblies 11 are coupled to and operable to independently raise the intermediate right and left-side vertices 74 and 75 relative to the other vertices. In this embodiment, two flexible mattress-supporting foundations or hammocks 14 are incorporated for torso support.

E. Alternative Embodiment of FIGS. 25-27

Figure 25:
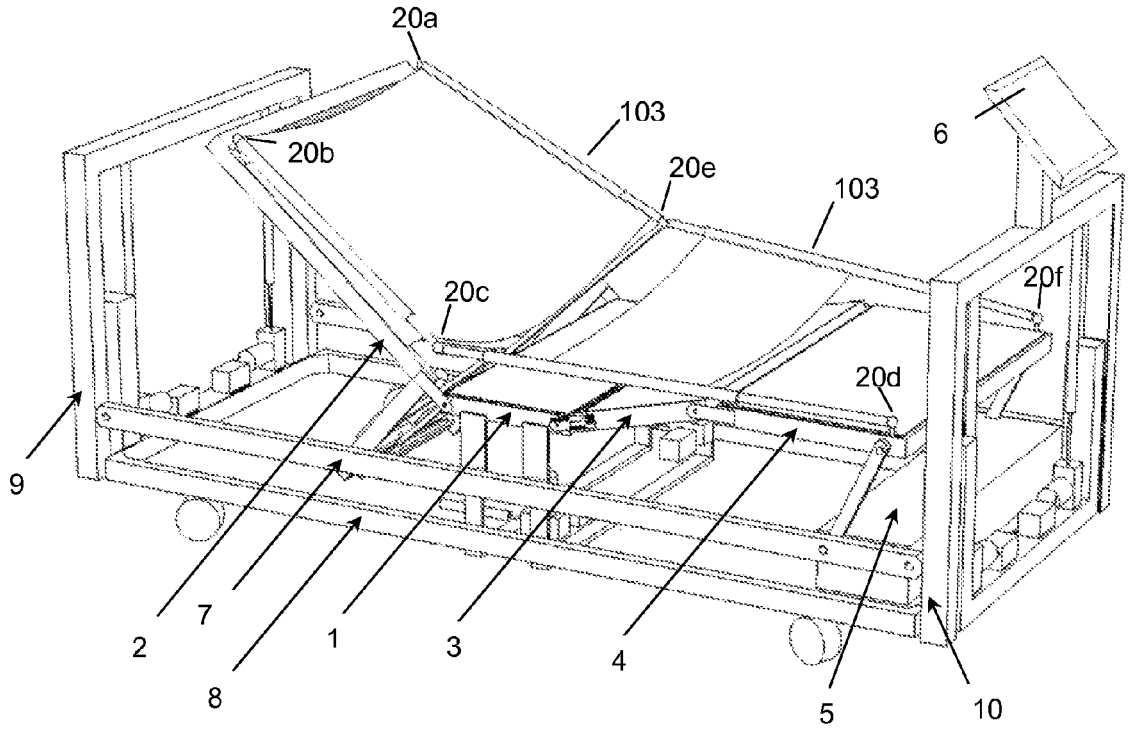
FIG. 25 illustrates a perspective view of a simplified adjustable bed 100 that is especially adapted to a home embodiment.
Figure 26:
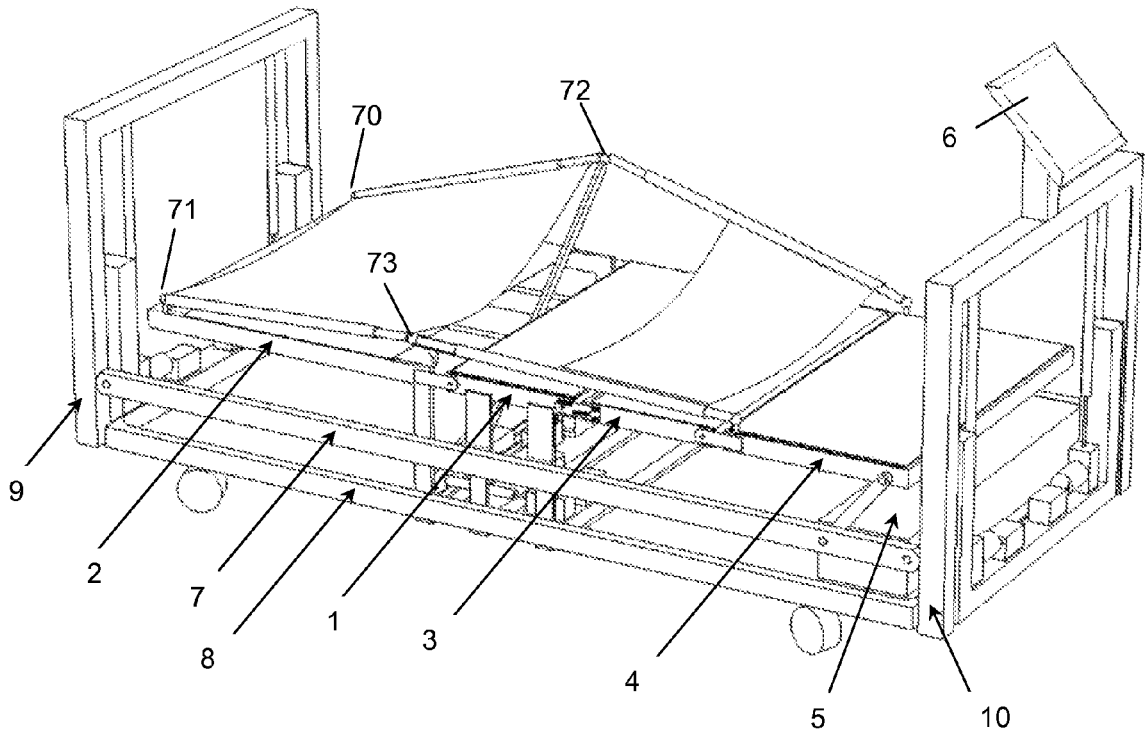
FIG. 26 illustrates the adjustable bed of FIG. 25 in a patient-tilting mode.
Figure 27:
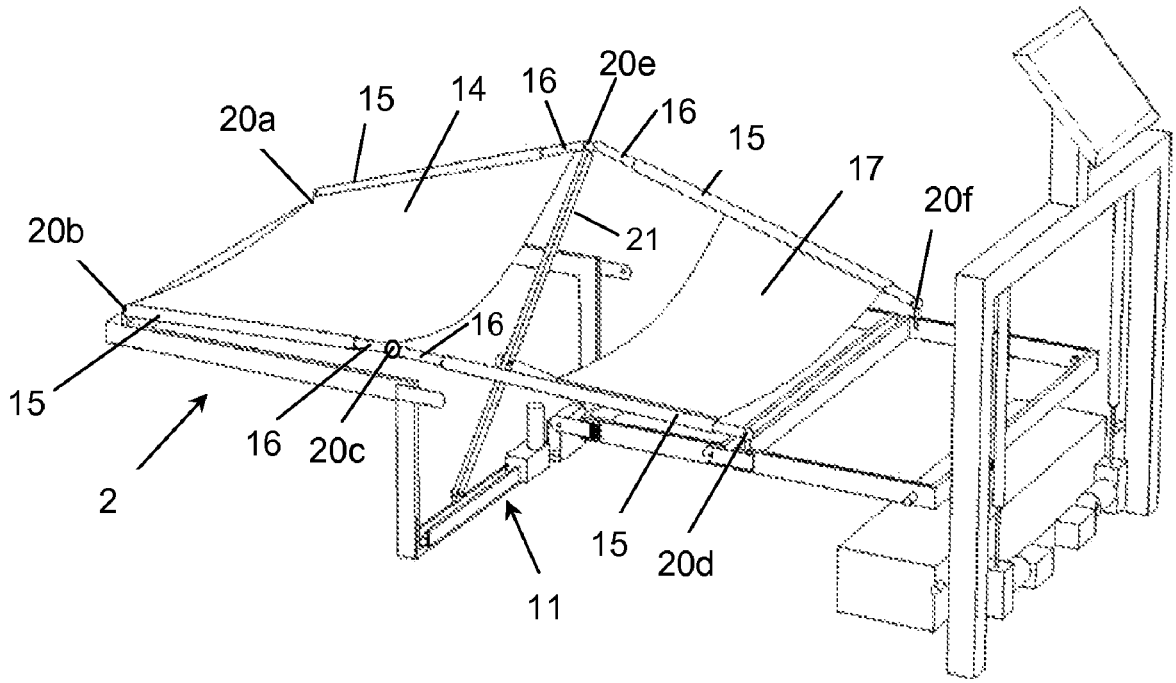
FIG. 27 illustrates the adjustable bed of_FIG. 26 with emphasis on the lateral actuation mechanism.

FIGS. 25-27 illustrate a perspective view of a simplified embodiment of an adjustable bed 100 preferred for home use. Like the previously discussed embodiments, this embodiment comprises an adjustable patient support framework 95 mounted on a base platform 90. But here, the adjustable patient support framework 95 has only two independently movable vertices—the inferior right side vertex 72 and the inferior left side vertex 73 (FIG. 26)—and corresponding independently controllable actuator assemblies. These two movable vertices 72 and 73—which are made up of central joints 20*e* and 20*c* (FIG. 26), respectively—allow for a degree of rotation of the torso, waist and leg area. The superior right and left side vertices 70 and 71 (FIG. 26), which are made up of superior joints 20*a* and 20*b* (FIG. 27), respectively, are fixedly joined to the torso support base section 62. Besides the side support bars 103 that join the central joints 20*e* and 20*c* to the superior joints 20*a* and 20*b*, additional telescoping side support bars 103—each comprising an inner telescoping rod 16 slidable within an outer rod 15—link the central joints 20*e* and 20*c* to inferior joints 20*a* and 20*b* that are affixed to the lower-leg support structure 4.

E. Alternative Embodiment of FIG. 34

Figure 33:
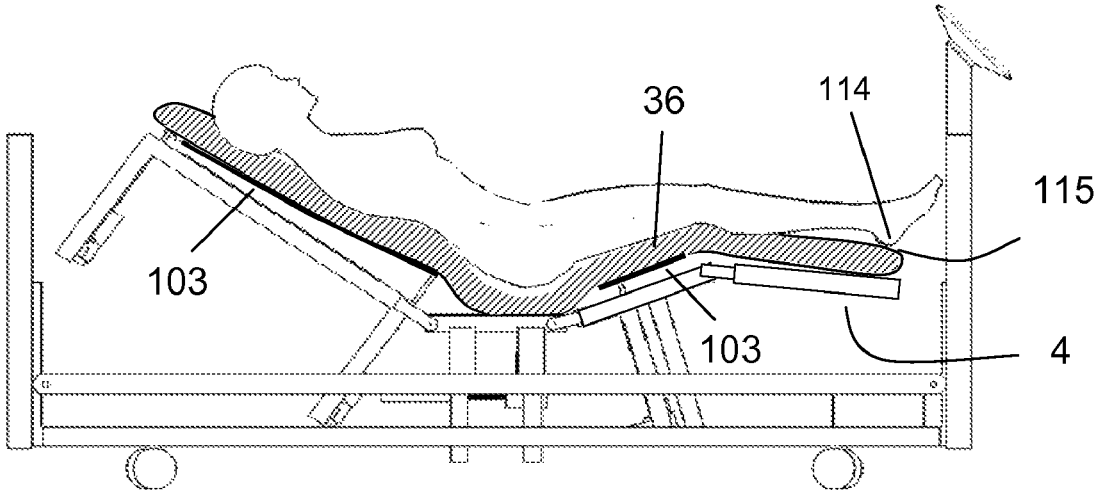
FIG. 33 illustrates a side view of the adjustable bed of FIG. 1.
Figure 34:
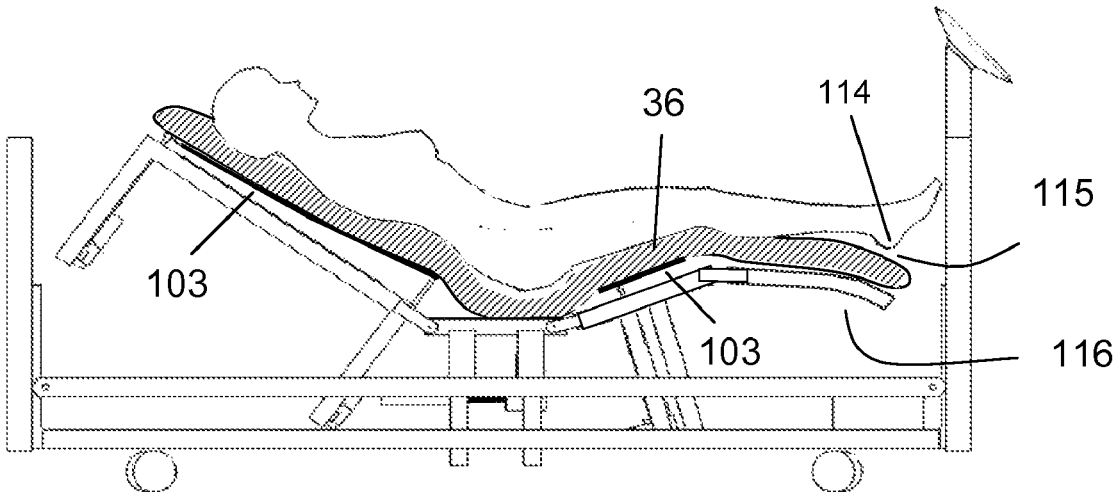
FIG. 34 illustrates a lateral sectional view of an alternative embodiment of the adjustable bed of FIG. 1 that relieves the pressure on the heel area.
Figure 35:
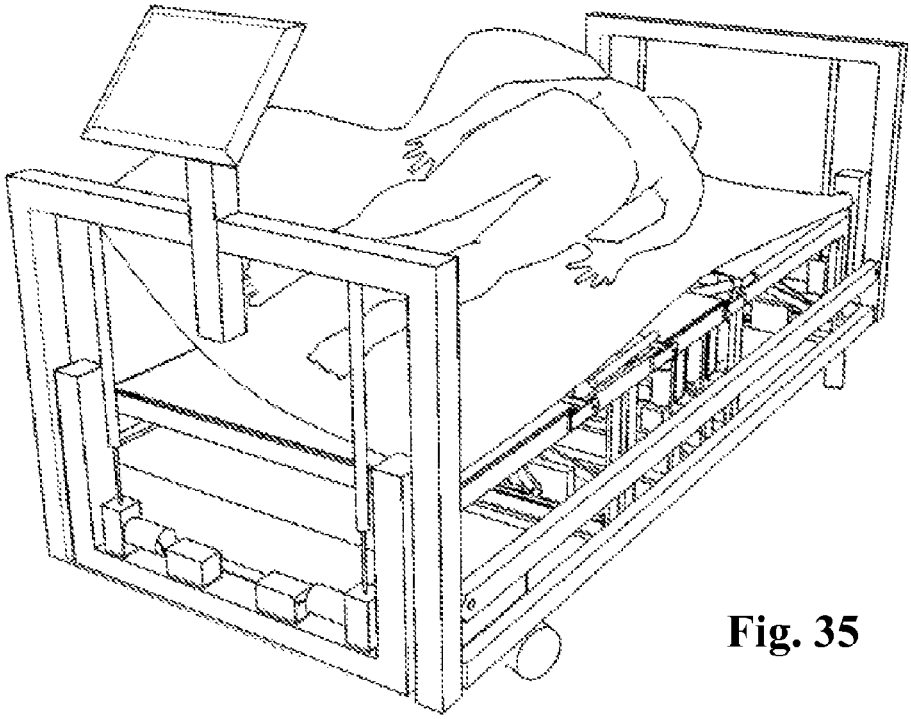
FIG. 35 illustrates a perspective view of the adjustable bed with the patient support surface being modulated to maintain a patient in a prone and rotated position.
Figure 36:
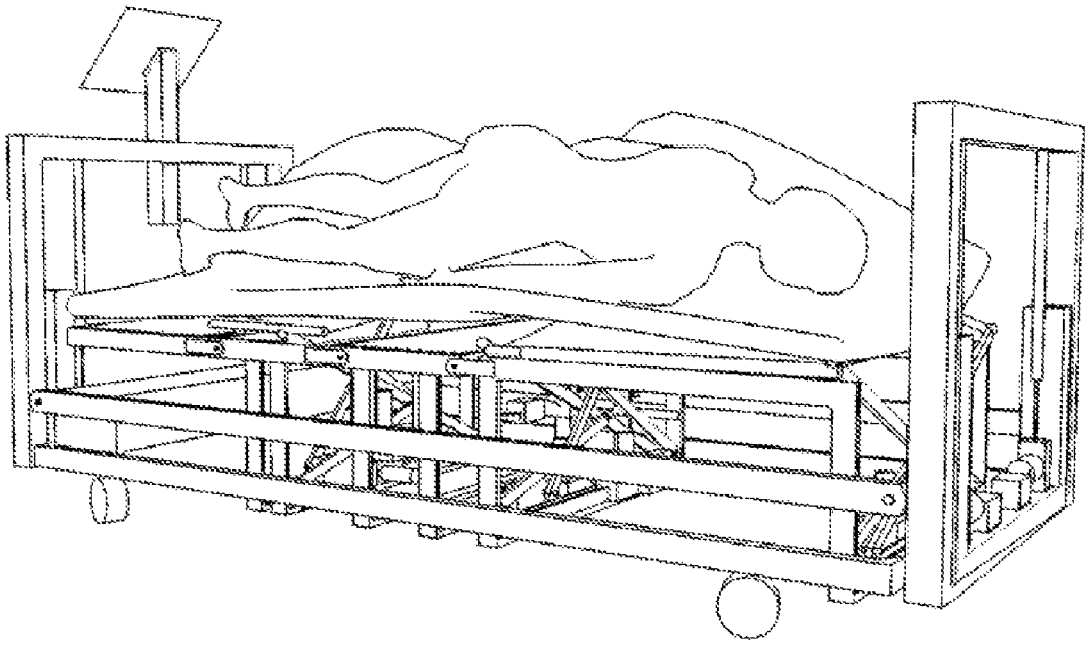
FIG. 36 illustrates the adjustable bed of FIG. 35 from an alternative perspective view for clarity.

FIGS. 33 and 34 illustrate two embodiments of the adjustable bed 100 with different lower-leg supporting structures 4 and 116. In FIG. 33, the upper surface of the lower-leg supporting structure 4 is substantially planar. In FIG. 34, the upper surface of the lower-leg supporting structure 116 is curved into a concave shape to minimize pressure on the patient's heels, and even to enable the patient's heels to float. This assembly facilitates rapid healing in preexistent pressure ulcers.

F. Alternative Embodiment of FIGS. 41 & 42

Figure 41:
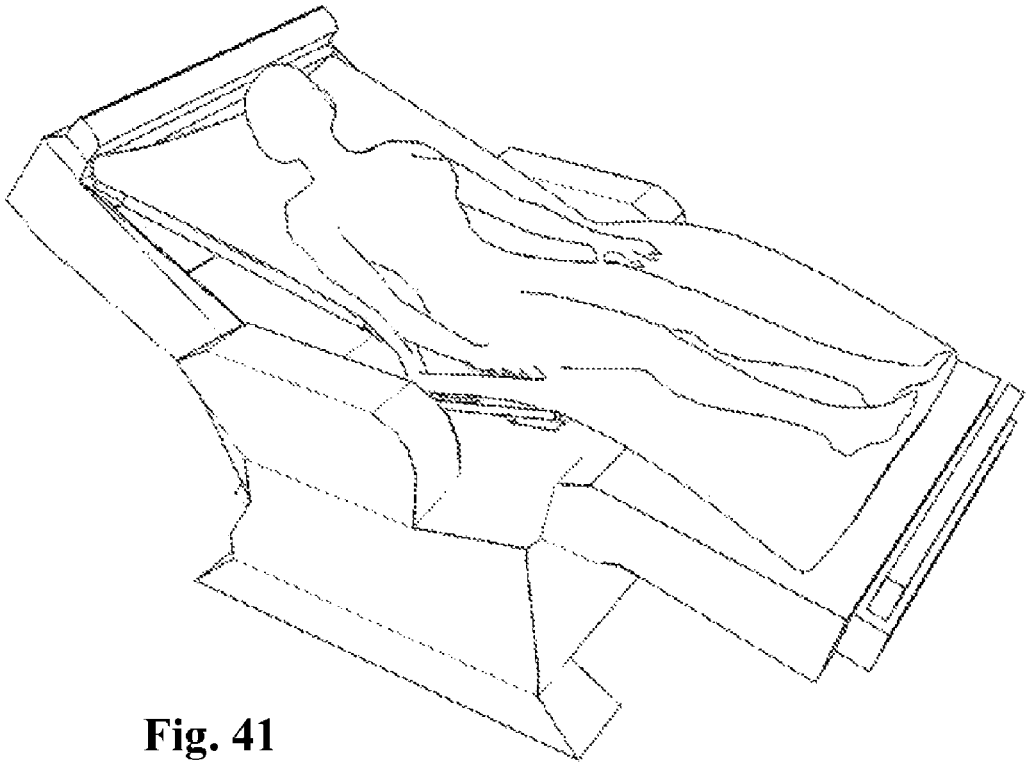
FIG. 41 illustrates a perspective view of an embodiment of the adjustable bed adapted to an airplane seat embodiment.
Figure 42:
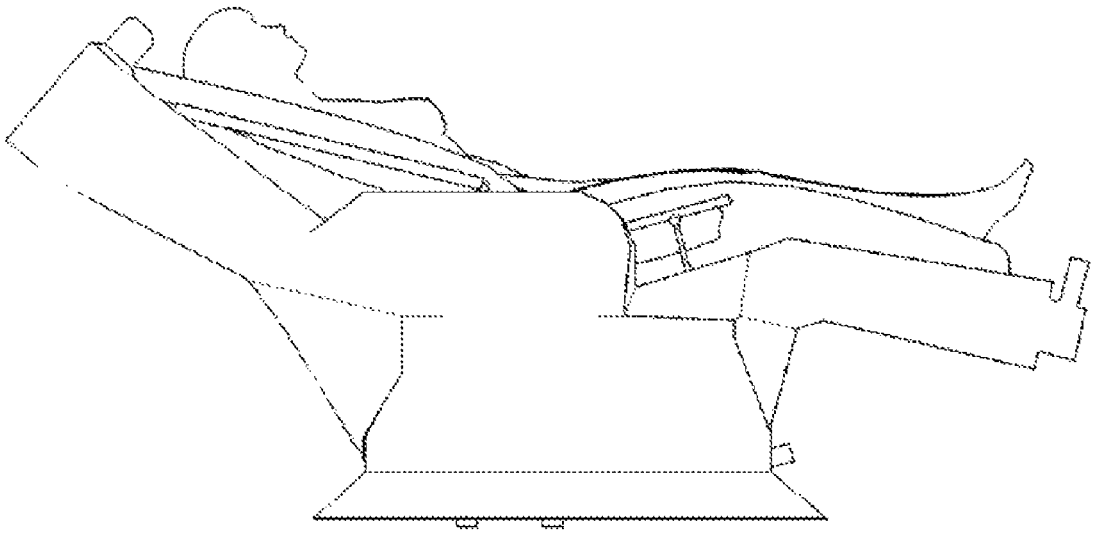
FIG. 42 illustrates a side view of the adjustable bed embodiment of FIG. 41.

FIGS. 41 and 42 illustrate perspective views of the adjustable bed 100 in the form of an airplane seat. All the mobility described in the bed embodiment is available for use here in a long distance travel. Here, the leg set may be flexed towards the floor.

G. Alternative Embodiment of FIG. 43

Figure 43:
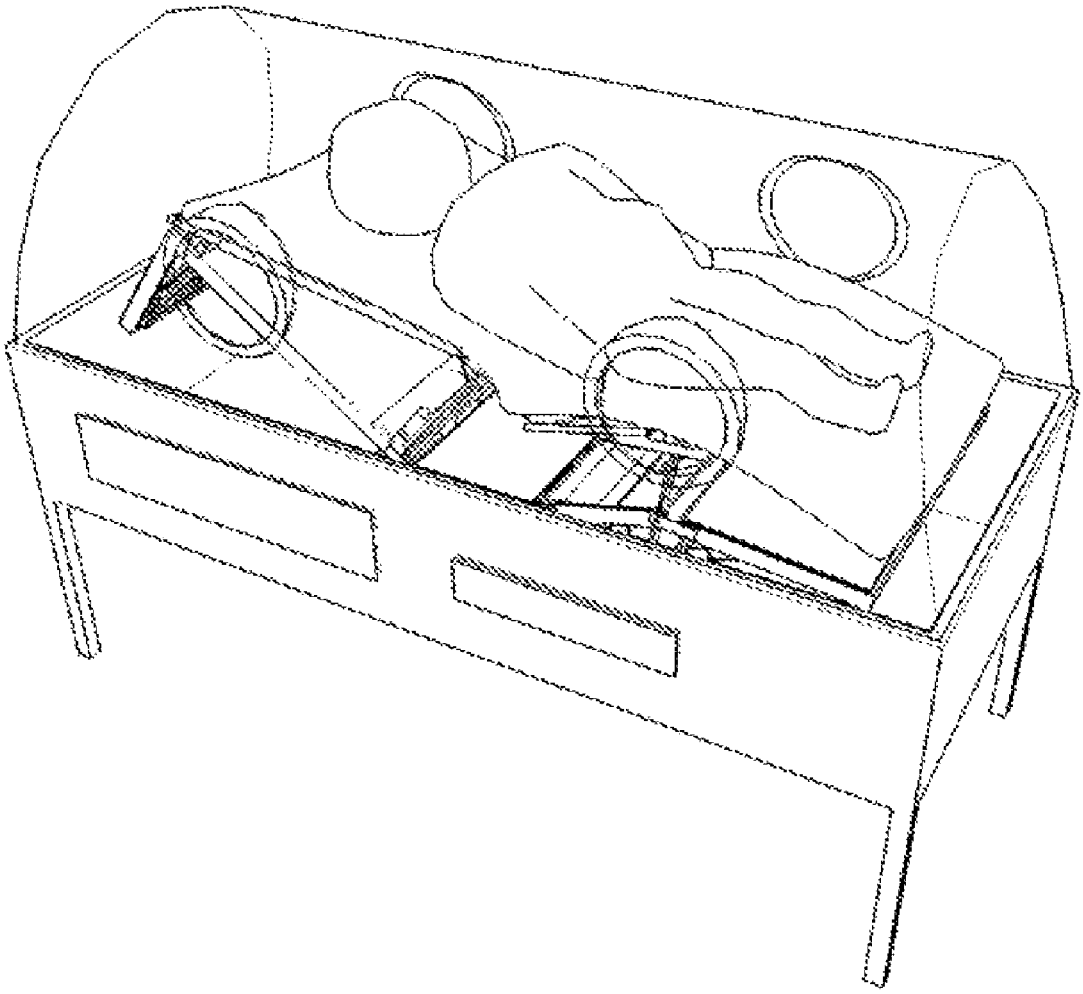
FIG. 43 illustrates a perspective view of an embodiment of the adjustable bed in an incubator embodiment.

FIG. 43 illustrates a perspective view of a miniaturized version of the adjustable bed 100 inside an incubator embodiment. All the mobility described in the bed embodiment is available for stimulation of a new born. It is known that this stimulatory process requires permanent random mobility, which can be obtained easily with this invention.

III. Therapeutic Modes of Operation

The patient support surface 36 of the adjustable bed 100 is modulated and configured through a combination of articulation of the base platform 90 and adjustment of the plurality of independently adjustable vertices (or points) 70-75 and segments 76-77 of the adjustable patient support framework 95, all of which are oriented at or near the periphery or perimeter area 81 of the overlying patient support surface 36.

Figure 31:
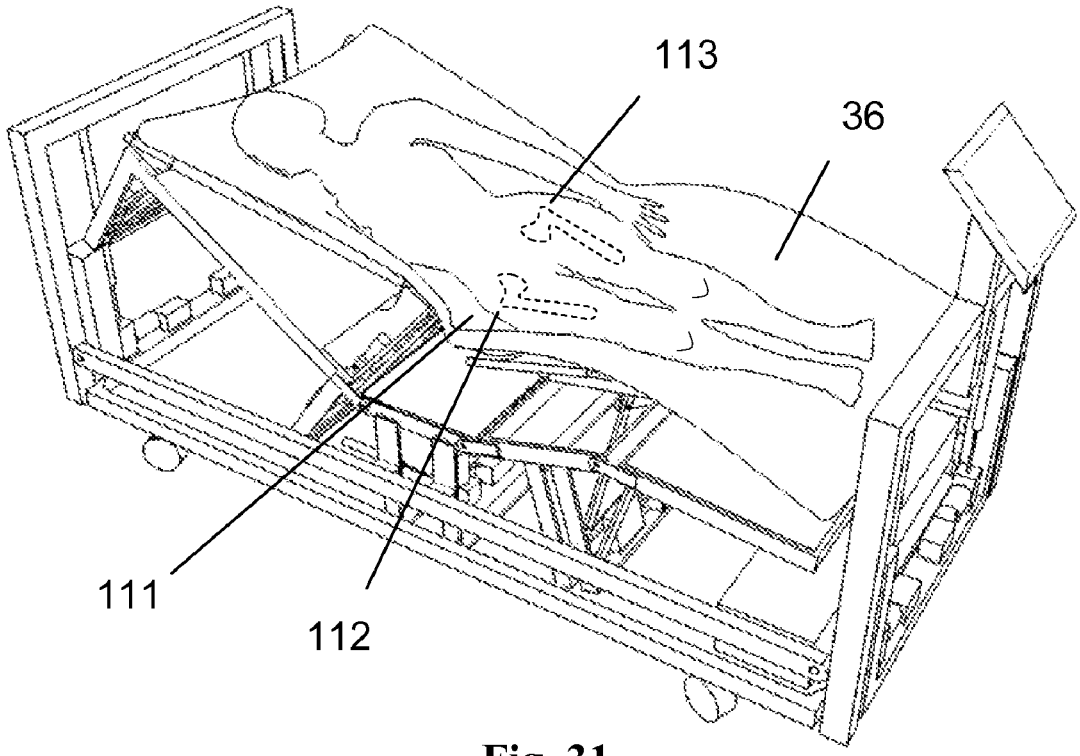
FIG. 31 illustrates a perspective view of the patient support surface being modulated to rotate the patient towards his right side while relieving pressure on the head of right throcanter.
Figure 32:
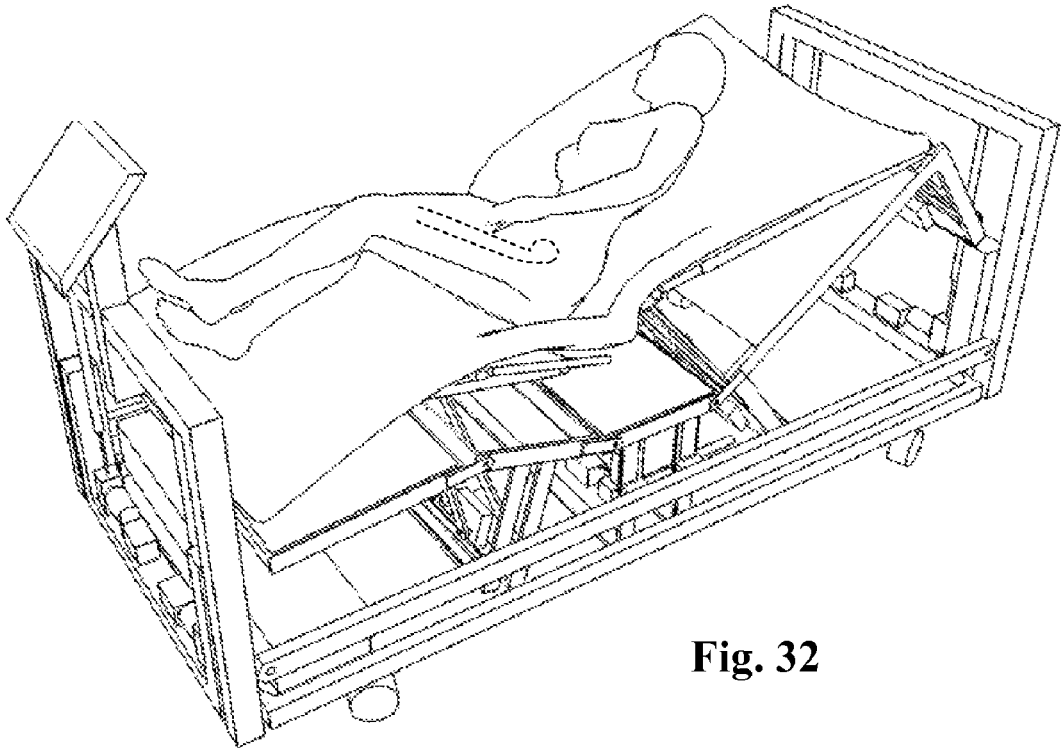
FIG. 32 illustrates the patient support surface of FIG. 31 from the opposite perspective view.

The adjustable patient support framework 95 of the adjustable bed 100 facilitates a wide variety of modulations of the patient support surface 36. For example, the patient support framework 95 can be modulated to cause lateral rotation of the patient from side to side, as illustrated in FIGS. 31 and 32 for a patient in the supine position and in FIGS. 35 and 36 for a patient in the prone position. This can be accomplished by selectively raising either the left or the right independently movable vertices and segments of the patient support framework 95.

Figure 39:
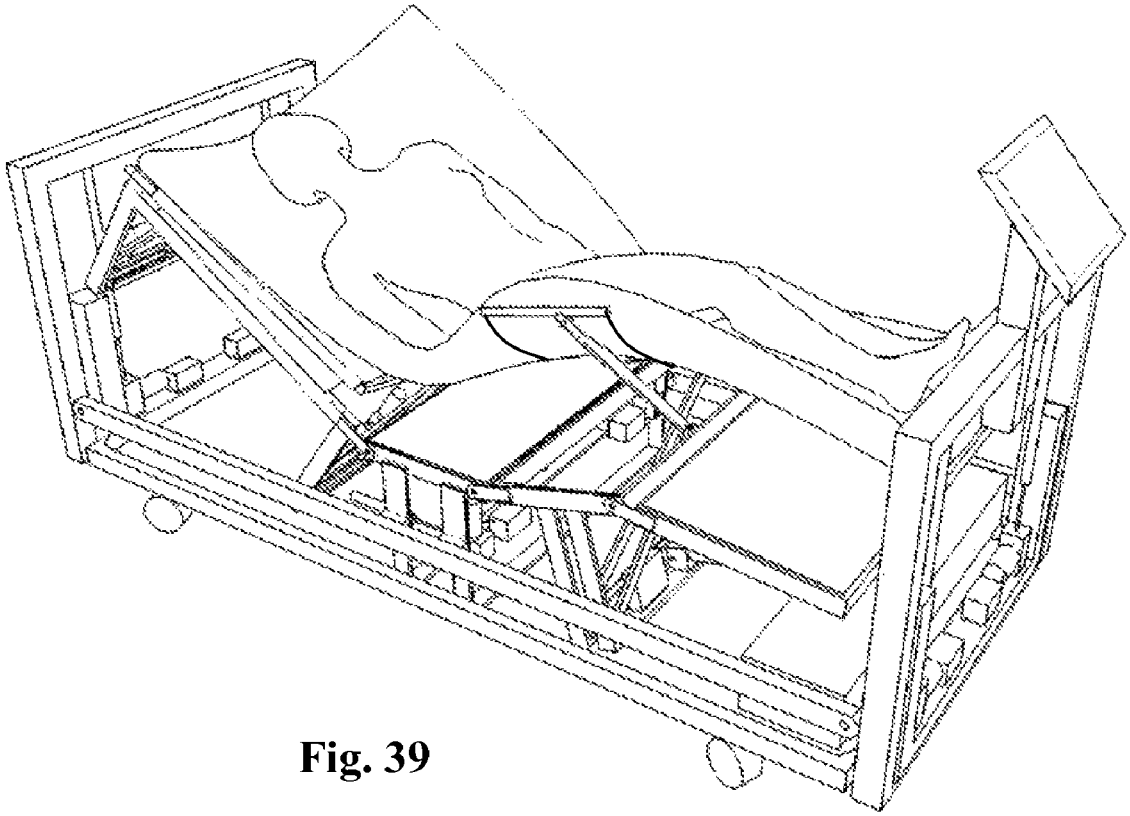
FIG. 39 illustrates a perspective view of the adjustable bed with the patient support surface in a patient-twisting mode to cause counter-rotation of the patient's torso and legs.
Figure 40:
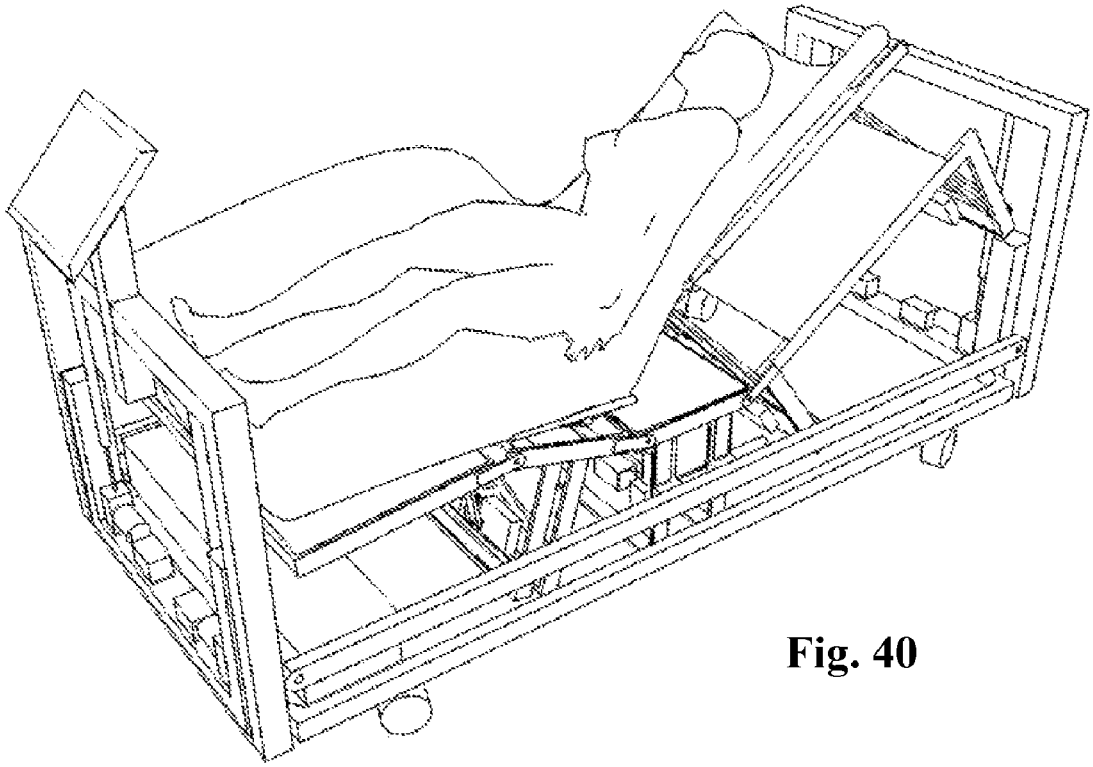
FIG. 40 illustrates the embodiment of FIG. 39 from an alternative perspective view for clarity.

Alternatively, the patient support framework 95 can be modulated to rotate the torso and legs in opposite directions, in a twisting mode, as illustrated in FIGS. 39 and 40. This can be accomplished by selectively raising the right vertices 70 and 72 (relative to the left vertices 71 and 73) while simultaneously selectively raising the left side support bar 77 (relative to the right side support bar 76). This can also be accomplished by selectively raising the left vertices 71 and 73 (relative to the right vertices 70 and 72) while simultaneously selectively raising the right side support bar 76 (relative to the left side support bar 77). A twisting mode may be indicated for patients with multi-fractures or other particular ailments that require the patient's torso and legs to be counter-rotated.

The patient support framework 95 can also be modulated to selectively squeeze the periphery of the patient support surface 36 on either side of a patient's waist or hips or both to distribute pressure over a wider area and help maintain the patient in position during other bed movements. It can also be modulated to selectively elevate the torso and hip-supporting areas of the patient support surface 36 relative to a pelvic-supporting area of the patient support surface 36, to thereby relieve pressure in that region. It can also be modulated to facilitate ingress and egress of a patient onto or off of the patient support surface 36.

These and other desired therapeutic effects can be achieved by acting on the preferably at least six independently movable points or segments of perimeter area, in conjunction with various movements of the articulating torso support structure 2, hip support structure 3 and leg support base structure 4. These six lateral points or segments of perimeter area are preferably positioned at or near areas of the patient support surface corresponding to the right shoulder, the left shoulder, the right waist, the left waist, the right hip, and the left hip of a patient resting on the patient support surface. The position of the lower-body supporting section 82 of the patient support surface 36 is indirectly affected by modulation of the other perimeter points or sections. In principle, the greater the number of independently movable vertices and segments, the greater the number of possible configurations into which the patient support surface 36 can be modulated.

A. Selective Squeezing Mode

Figure 28:
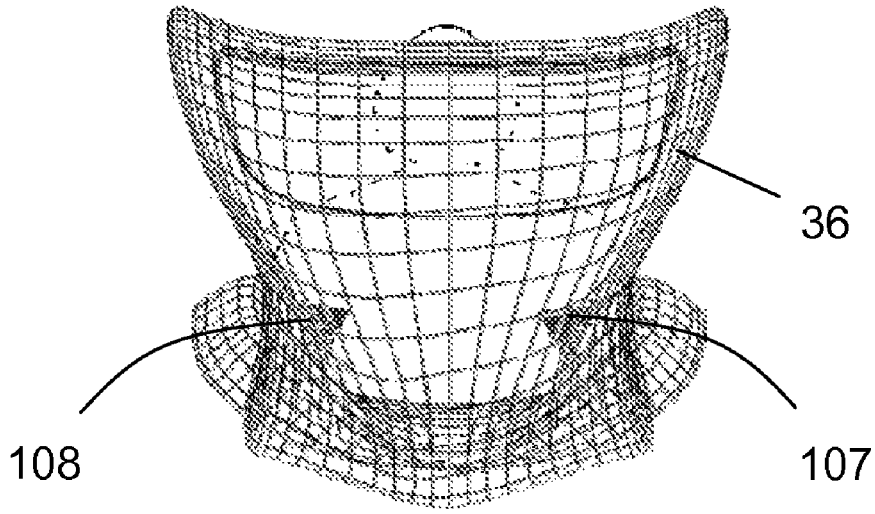
FIG. 28 illustrates a perspective dorsal view of the patient support surface being modulated to selectively squeeze the patient support surface on either side of a patient's waist.
Figure 29:
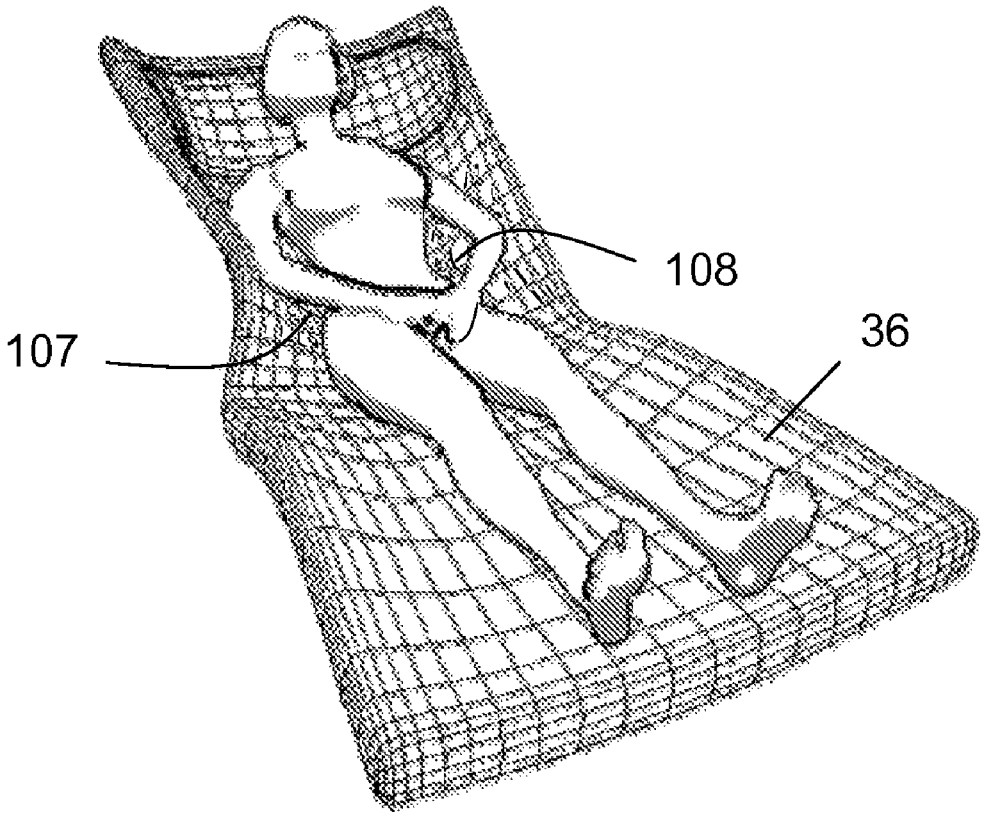
FIG. 29 illustrates the opposite perspective view of the patient support surface of FIG. 28.

FIGS. 28 and 29 show perspective views of the patient support surface 36 being modulated to selectively squeeze the patient support surface 36 on either side of a patient's waist. In this configuration, the patient's right waist area 107 and left waist area 108 are hugged by the patient support surface 36. This action results from the activity of two of the actuators 11 of torso support structure 2 to raise and pull inward the inferior right and left vertices 72 and 73.

In like manner, activity by the actuators 11 of the hip support structure 3 to raise and pull inward the right and left side support bars 76 and 77 causes a selective squeezing of the right-hip-adjacent peripheral portion 123 and the left-hip-adjacent peripheral portion 127 of the patient support surface 36. In this manner, it will be observed that the right and left side support bars 76 and 77 move along trajectories between a first relative position of maximum distance between the left and right support rods 76 and 77 and a second relative position in which the left and right support rods 76 and 77 approach the hips of a patient resting on the patient support surface 36. Such action further inhibits a patient resting on the patient support surface 36 from rolling off of the patient support surface 36 during lateral rotation movements or to minimize patient movements during other adjustments of the adjustable bed 100.

If the patient is rotated to any side or submitted to side-to-side rotation, the patient is maintained in that position, without sliding. This not only reduces the danger of shear lesions, but also facilitates a greater degree of rotation of the patient than would otherwise be possible.

Moreover, these maneuvers can distribute the patient's load over a wider area. FIG. 31 illustrates a perspective view of a patient resting on a patient support surface 36 that has been modulated to tilt the patient toward one side while creating a trough 111 that prevents the patient from rolling off of the patient support surface. When the patient is turned on her/his right side, the head of right throcanter 112 (opposite the patient's left throcanter 113) falls into the trough 111. This position results from a combination of torso elevation, selective squeezing of the two inferior actuators 11 of the torso support structure 2, and selective squeezing of the actuators of the hip support structure 3. Similarly, when the patient is turned on her/his left side, the converse happens.

It should be noted that a selective squeezing of opposite side portions of the patient support surface 36 can be effected through a single actuator operating on both opposite side portions of the patient support surface. Therefore it will be understood that one aspect of the invention covers adjustable beds that use a single actuator to accomplish an selective squeezing operation.

Preferably, the control and processing unit 5 is programmed with a plurality of selective squeezing modes. In a basic squeezing mode, the control and processing unit 5 is programmed to modulate the right-hip-adjacent peripheral portion 123 and the left-hip-adjacent peripheral portion 127 of the patient support surface 36 to inhibit a patient resting on the patient support surface 36 from rolling off of the patient support surface 36. In a patient-tilting mode, the control and processing unit is programmed to simultaneously or sequentially (although not necessarily in the particular order shown below) effect the following modulations of the patient support surface 36:

(a) raise the right-torso-adjacent peripheral portion 121 above the left-torso-adjacent peripheral portion 129 in order to tilt a patient's torso toward one side;

(b) raise the right-calf-adjacent peripheral portion 124 above the left-calf-adjacent peripheral portion 126 in order to tilt a patient's legs toward one side; and (c) raise the left-hip-adjacent peripheral portion 127 to create a trough in the patient support surface for embracing a right hip of a patient resting on the patient support surface 36 and thereby inhibiting the patient from rolling off of the patient support surface 36.

In a patient-twisting mode, the control and processing unit 5 is programmed to simultaneously or sequentially (although not necessarily in the particular order shown below) effect the following modulations of the patient support surface 36:

(a) raise the right-torso-adjacent peripheral portion 121 above the left-torso-adjacent peripheral portion 129 in order to tilt a patient's torso to the left;

(b) raise the left-calf-adjacent peripheral portion 126 above the right-calf-adjacent peripheral portion 124 in order to tilt a patient's legs to the right; and (c) raise both the left-hip-adjacent peripheral portion 127 and the right-hip-adjacent peripheral portion 123 to create a trough in the patient support surface 36 for embracing the hips of a patient resting on the patient support surface 36 and thereby inhibiting the patient from rolling off of the patient support surface 36.

B. Pelvic-Pressure Relief Mode

Figure 30A:
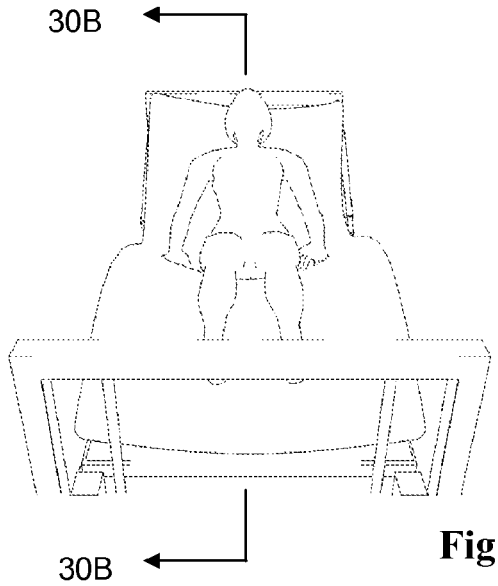
FIG. 30A illustrates a frontal view of the patient support surface being modulated to relieve pressure on a patient's sacral area.
Figure 30B:
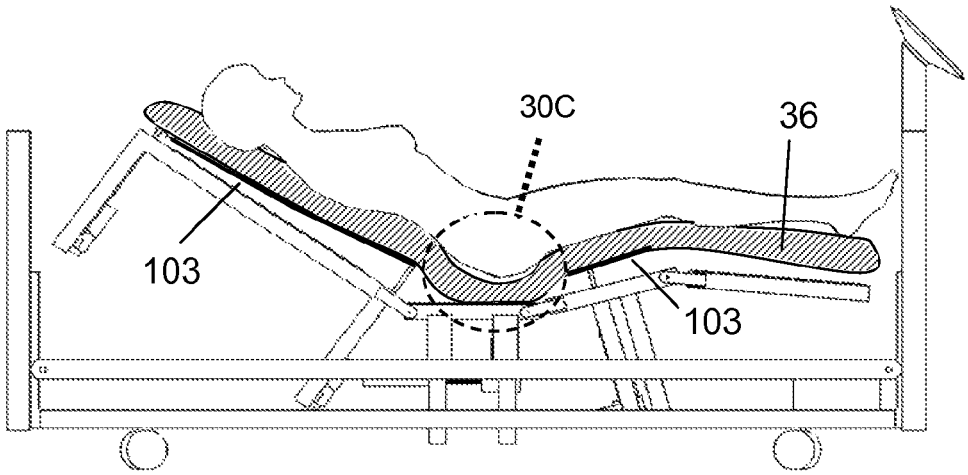
FIG. 30B illustrates a lateral sectional view of FIG. 30A, showing pressure relief to the sacral area.
Figure 30C:
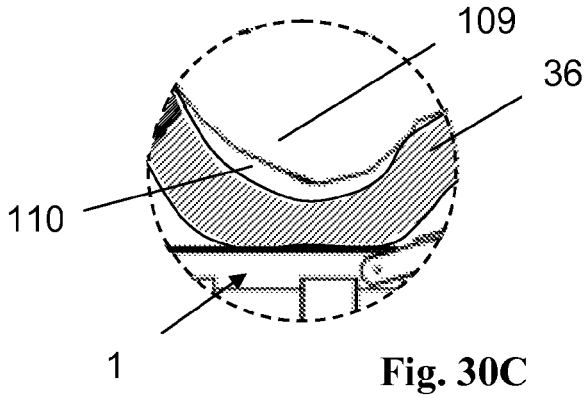
FIG. 30C illustrates a magnifying view of FIG. 30B, which details the pressure relief to the sacral area.

FIGS. 30A-30C illustrate modulations of the patient support surface 36 to selectively elevate the torso and hip-supporting areas of the patient support surface 36 relative to a pelvic-supporting area of the patient support surface 36, to thereby relieve pressure in that region. This can be accomplished by elevating at least the inferior left and right vertices 72 and 73 of the torso support litter 68 and the right and left side support bars 76 and 77 of the hip support litter 69 sufficiently to substantially reduce pressure on the sacral area of a patient resting on the patient support surface 36.

It should be noted that embodiments of the adjustable bed 100 could be provided wherein elevation of both inferior left and right vertices 72 and 73 is effected through a single lifting mechanism mounted on the torso support base structure 62. Likewise, embodiments of the adjustable bed 100 could be provided wherein elevation of both the right and left side support bars 76 and 77 are effected through a single lifting mechanism mounted on the hip support base structure 63. Therefore it will be understood that one aspect of the invention covers adjustable beds that just one or two lifting mechanisms to accomplish sacral pelvic-pressure relief mode.

FIG. 30A illustrates a frontal perspective view of a position for sacral pressure relieve. FIG. 30B shows a sectional lateral view of FIG. 30A when the patient is semi-seated and indicates that the support of the patient is exerted mostly by the torso and upper leg area. FIG. 30C is an enlargement view that shows a trough 110 or area of minimal contact between the sacrum 109 and patient support surface 36. This position results from the combined action of torso elevation and operation of the actuators of the hip set to elevate and hug the patient's hips.

Preferably, the control and processing unit 5 has a pre-programmed mode operable to modulate the periphery 81 to raise the patient's sacrum above the patient support surface 36, and thereby relieve pressure on the patient's sacrum. More particularly, this pre-programmed mode is operable to modulate the periphery 81 by raising the right-torso-adjacent peripheral portion 121 and right-hip-adjacent peripheral portion 123 above the intermediate right-side peripheral portion 122, and by raising the left-torso-adjacent peripheral portion 129 and left-hip-adjacent peripheral portion 127 above the intermediate left-side peripheral portion 128.

C. Ingress and Egress-Facilitating Mode

Figure 37:
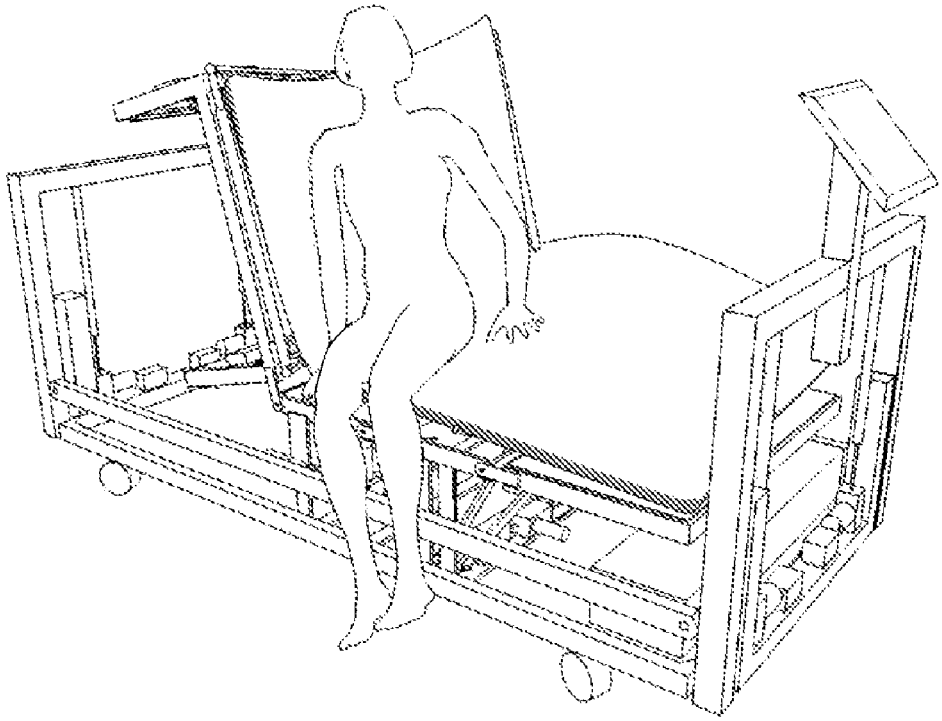
FIG. 37 illustrates a perspective view of the adjustable bed with the patient support surface modulated to facilitate patient ingress or egress on or off the adjustable bed.
Figure 38:
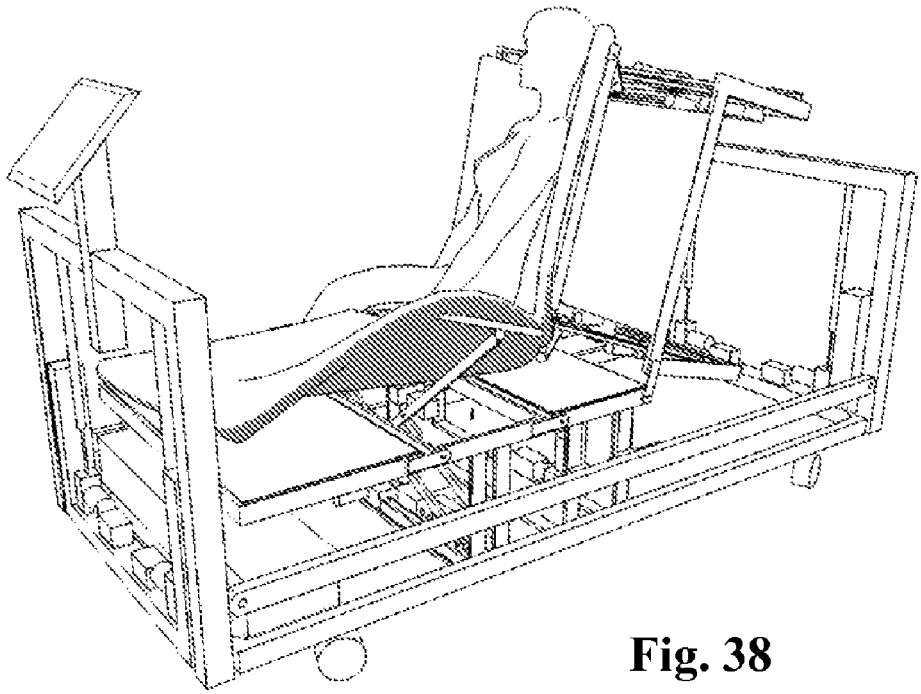
FIG. 38 illustrates the embodiment of FIG. 37 from an alternative perspective view.

FIGS. 37 and 38 illustrate modulations of the patient support surface 36 to facilitate ingress and egress of a patient onto or off of the patient support surface 36. Egress of a patient off of the patient support surface 36 is facilitated by simultaneous or sequential actuation of the following movements: articulating the torso support base structure 62 to a substantially upright position (e.g., more than 45 degrees); and selectively raising either the right side support bars 103*a* and 76, or the left side support bars 103*b* of 77, of the torso support structure 62 and hip support structure 63 to moderately tilt the upper-body supporting section 82 and midsection 83 of the patient support surface 36 to the left or right. Actuation of the same movements in reverse facilitates ingress of a patient onto the patient support surface 36. In both cases, patient entry onto, or exit from, the adjustable bed 100 is accomplished with minimal caregiver aid.

It should be noted that embodiments of the adjustable bed 100 could be provided wherein elevation of both right side vertices 70 and 72, or both left side vertices 71 and 73, is effected through a single lifting mechanism mounted on the torso support base structure 62. Therefore it will be understood that one aspect of the invention covers adjustable beds that just one or two lifting mechanisms to accomplish the ingress- or egress-facilitating mode.

The control and processing unit 5 preferably has a pre-programmed mode operable to automatically articulate the torso-support base structure 62 and raise either the right side support bars 103*a* and 76, or the left side support bars 103*b* and 77, to facilitate bed ingress or egress.

Stated another way, the control and processing unit 5 preferably has a pre-programmed mode to modulate the right-torso-adjacent peripheral portion 121 and the right-hip-adjacent peripheral portion 123, or alternatively to modulate the left-torso-adjacent peripheral portion 129 and the left-hip-adjacent peripheral portion 127, of the patient support surface 36 to facilitate egress by a patient resting on the patient support surface 36 off of the patient support surface 36. More particularly, this mode is programmed to raise the right-torso-adjacent peripheral portion 121 above the left-torso-adjacent peripheral portion 129, or vice versa, in order to tilt a patient's torso toward one side; and raise the right-hip-adjacent peripheral portion 123 above the left-hip-adjacent peripheral portion 127, or vice versa, in order to tilt a patient's legs toward one side.

IV. Programmable Control of the Bed

Figure 11:
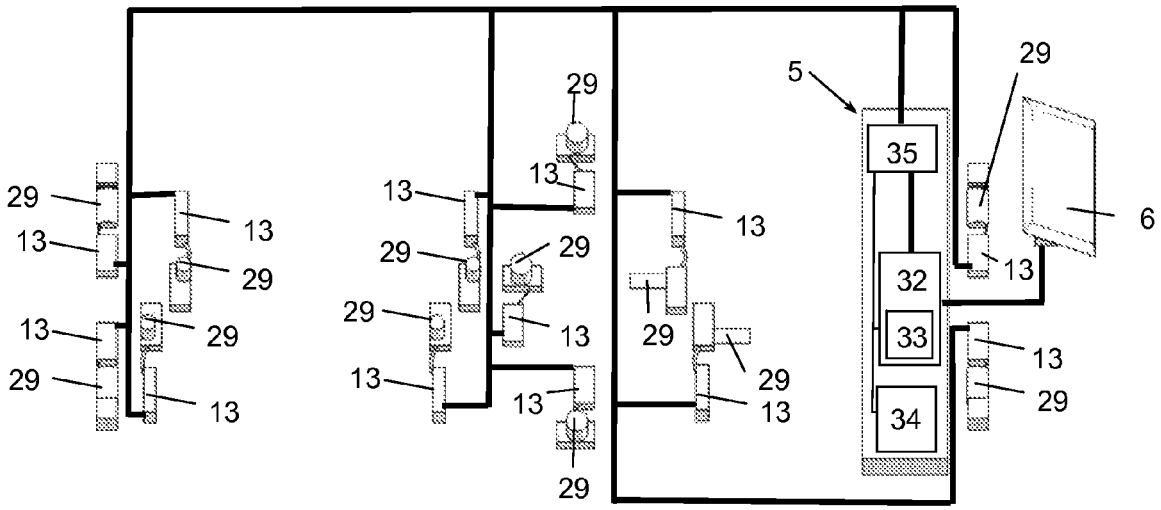
FIG. 11 illustrates a partial top plan view of electrical connections between parts of the adjustable bed.

FIG. 11 is an abbreviated schematic diagram of electrical connections between various parts of the adjustable bed 100. A control panel 6, which preferably comprises an interactive user interface touch-screen monitor, provides a caregiver the capability to adjust the movable surfaces of the bed into desired positions, and to select pre-programmed routines, or program new routines, of successive movements of the adjustable bed 100. The control panel 6 is connected to a control and processing unit 5. This control and processing unit 5 contains a central processing unit (CPU) 32, a memory 33, a power source 34 and an interface 35 with several peripheral control units 13. Each peripheral control unit 13 drives a defined movement. Moreover, each motor 29 or actuator has a security switch in both ends of the running means to preclude greater displacement than what is allowed.

The control and processing unit 5 also comprises one or more interfaces for connection with an external computer and other instruments and electronic devices. Various patient mobilization routines can be programmed into the control and processing unit 5 and can be administered continuously or episodically by the caregiver through the control panel 6.

In one embodiment the control unit 13 receives from the CPU 32 movement commands, e.g. positions, velocities and special action, and executes algorithms via an incorporated microcontroller, thus driving each actuator's mechanism to reach the pre-programmed position. The trigger for each movement originates from a control panel 6 order. The CPU 32 then sends to a corresponding control unit 13 the desired position and command information using bidirectional communication protocol. Next the control unit 13 analyzes the position information, determines the difference between the actual position and the desired position and drives the actuators until the desired position is achieved. Velocity information may also be sent, as defined by the central processing unit 32's algorithm plus the caregiver's input via the control panel 6. In another embodiment, there is no microcontroller in the control unit 13, and the CPU 32 triggers signals to the control unit to the actuators.

The storage memory for the algorithms and position data may be distributed among the CPU 32 and the control units 13. The CPU 32 may have a high storage capacity while each control unit 13 has relatively less storage capacity. The means for CPU storage is capable of collecting a diverse final bed position, e.g. cardiac chair, etc., several sequences of patient movements, e.g. defined trajectories, algorithms for generation of the bed movement programs for prevention and/or treatment activities. The means for CPU storage may be capable of accumulating a clinical history database as well as accumulating clinical treatment results data. The means for CPU storage is capable of adding usage data for the technology described herein, e.g. a record of position information by time.

The control panel 6 also preferably presents intuitive selectable screen menus to the caregiver. The control panel 6 may be capable of having access levels controls, e.g., by password, biometrics, card key, etc. The control panel 6 may have a sector screen to manually direct the actuators, e.g. up, down. In close proximity to the manual mode controls may be a visual indication showing the actual position and the desired position. The control panel 6 may have a portion of the screen that shows a perspective view of the desired position of the bed 100 so that the caregiver has an initial impression of the patient movement desired for confirmation or correction. The control panel 6 may also have an interface screen for inputting individual patient data, e.g. status of consciousness, possible restrictions to movement, previous sites of occurrence of pressure ulcers or lesions, etc., in order to trigger a specific prevention/treatment routine. The control panel 6 may be capable of pausing the routine that is in progress, via access from the patient or caregiver. Algorithms may control the pause duration.

The interface for the control panel 6, in a preferred form, is capable of multimedia output, including, but not limited to, offering audio advice to a caregiver, graphical advices and warnings as warranted. The control panel 6 may include pre-set memory position activators, e.g. buttons. Each button triggers a predetermined final position, e.g. cardiac chair, RX position, eating, resting, etc. The control panel 6 may include customizable memory position activators to save positions desired by a caretaker. The control panel 6 may include trajectory memory activators. A trajectory is defined as a series of predefined positions successively executed from an initial position to a final position. This allows for triggering specific movements of a patient by defined buttons, e.g. bed egress and bed ingress as an aid to a caregiver. The control panel 6 may include means to activate a diurnal mode, i.e. more accelerated, and a nocturnal mode, i.e. slower. This capability may be set automatically as a function of clock information, or may be set manually by a patient.

The control panel 6 may contain a special CPR button for use in an emergency. Activating this CPR button triggers signals for a rapid descending of all actuator mechanisms. The control panel 6 may contain a special button for pausing of a movement in progress. Activating this pause button freezes all movements of the technology described herein. Subsequent activation of the pause button results in returning to the movement in progress. If the pause button is not reactivated there may be a return to the movement in progress after a pre-established time for ulcer prevention has passed. The control panel 6 may contain a special stop button to stop the movement in progress.

The control panel 6 may have the capability of allowing connection of a remote control for use by a patient. The connection between the control panel 6 and the remote control may be wired or wireless. The remote control may have reduced functionality and may be configurable to address different needs. The control panel 6 may contain means to activate a remote operation of the bed 100. This capacity may permit, e.g. via the Internet, total or partial control of the bed and total or partial access to the collected data. The control panel 6 may contain means for an audio-video connection, e.g. via the Internet, so that a visitor may have access in real time to audio and images of the patient. The control panel 6 may contain means to show the pressure value sensed via a special attachment for patient-to-mattress pressure determination. The control panel 6 may have the capability for the addition of specific controls to other accessories engaging the bed 100, e.g. motorized rail, proning attachment, etc.

The technology described herein may include a black box recording unit that documents parameters of usage. This black box may be used for maintenance needs or technical service, thus reducing outside operation time. The black box may provide information to a caregiver about the intensity of recent use that is related to a prevention/treatment action. The black box may be capable of permitting a pay system based on use. The black box may collect data for future analysis and development, thus providing relationships between a patient's diagnosis and best preventive or treatment programs.

The technology described herein may include algorithms controlling sequences of movements and executed from the control panel by a caregiver or patient. Each algorithm may contain all the information needed to execute a defined flow of movements. In one embodiment of the technology described herein a caregiver may have the ability to create his own algorithmic sequences, adapted to the specific needs of an individual patient. The newly generated sequences may remain stored in memory for evaluation and future usage. The CPU 32's algorithms may be directed to executing trajectories, generating movement flows, previewing movements, precluding mechanical interferences, establishing control units communication, modulating diurnal or nocturnal movement flows, determining index of use, documenting bed activity, etc. The control unit 6's algorithms may be directed to establishing communication with the CPU 32, driving actuators, sensing position, synchronizing the advance of parallel actuators, etc.

V. Conclusion

Having thus described exemplary embodiments of the present invention, it should be noted that the disclosures contained in FIGS. 1-44 are exemplary only, and that various other alternatives, adaptations, and modifications may be made within the scope of the present invention. Accordingly, the present invention is not limited to the specific embodiments illustrated herein, but is limited only by the following claims.

We claim:

1. An adjustable bed with a modulating patient support surface comprising:

an articulating, multi-sectioned base platform;

at least one platform-articulating actuator operable to articulate at least one section of the base platform;

an adjustable patient support framework mounted over at least two sections of the base platform and operable to be adjusted relative to the base platform, the adjustable patient support framework including at least two selectably adjustable peripheral support vertices operable to be elevated above the base platform to modulate the patient support surface;

the adjustable patient support framework further including at least two peripheral support segments, extending longitudinally along sides of the patient support surface, pivotally joined to the adjustable peripheral support vertices;

wherein the patient support surface is supported and operable to be modulated in part by the adjustable peripheral support vertices of the adjustable patient support framework; and one or more controllable actuators coupled to and operable to modulate the adjustable peripheral support vertices, wherein each controllable actuator coupled to and operable to modulate the adjustable peripheral support vertices comprises:

a sliding element;

a sliding guide that confines the movement of the sliding element;

a principal arm having superior and inferior ends, the inferior end of which is hingedly linked to the sliding element, and the superior end of which is joined to one of the peripheral adjustable vertices; and a secondary arm having superior and inferior ends, the inferior end of which is hingedly linked to a section of the base platform and the superior end of which is hingedly joined to a midsection of the principal arm.

2. The adjustable bed of claim 1, further characterized in that:

one of the sections of the articulating, multi-sectioned base platform is an articulating torso support section, the torso support section including a superior end and an inferior end; and the adjustable peripheral support vertices of the adjustable patient support framework include at least two independently movable support vertices mounted on the inferior end of the torso support section and operable to be elevated above the torso support section.

3. The adjustable bed of claim 1, further characterized in that:

one of the sections of the articulating, multi-sectioned base platform is an articulating torso support section;

the adjustable peripheral support vertices of the adjustable patient support framework include four independently movable support vertices mounted on and operable to be elevated above the torso support section, two of which form a pair of right-side support vertices and another two of which form a pair of left-side support vertices; and the at least two peripheral support segments of the adjustable patient support framework include a first adjustable-length segment connecting the pair of right-side support vertices and a second adjustable-length segment connecting the pair of left-side support vertices.

4. The adjustable bed of claim 3, further characterized in that:

another one of the sections of the articulating, multi-sectioned base platform is an articulating hip support section for underlying the hips of a patient resting on the adjustable bed; and the adjustable patient support framework further includes at least two independently movable peripheral adjustable-support hip segments mounted on and operable to be elevated above the hip support section.

5. The adjustable bed of claim 1, further characterized in that:

one of the sections of the articulating, multi-sectioned base platform is an articulating torso support section for underlying the torso of a patient resting on the adjustable bed;

the torso support section includes a superior end and an inferior end;

the at least two peripheral support segments of the adjustable patient support framework include at least two peripheral adjustable support segments mounted on the inferior end of the torso support section and operable to be elevated above the torso support section; and the one or more controllable actuators coupled to and operable to modulate the adjustable peripheral support vertices are operable to raise the peripheral adjustable support vertices above the torso support section and pull the peripheral adjustable support vertices toward each other;

whereby the patient support surface is operable to embrace the hips of a patient resting thereon to minimize patient movements during adjustments of the adjustable bed.

6. The adjustable bed of claim 1, further characterized in that:

the sections of the articulating, multi-sectioned base platform include a pelvic support section situated between an articulating torso support section and an articulating hip support section;

the torso support section includes a superior end and an inferior end;

the adjustable peripheral support vertices of the adjustable patient support framework include at least two support vertices mounted on the inferior end of the torso support section and operable to be elevated above the torso support section;

the adjustable patient support framework includes at least two further peripheral adjustable hip support segments mounted on and operable to be elevated above the hip support section;

the one or more controllable actuators coupled to and operable to modulate the adjustable peripheral support vertices are operable to raise the peripheral adjustable support vertices above the torso support section; and one or more further controllable actuators are operable to raise the two further peripheral adjustable hip support segments above the hip support section;

whereby the patient support surface may be modulated so that portions of the surface corresponding to lower torso and hip regions are elevated above a portion of the surface corresponding to an intermediate pelvic region;

whereby the patient support surface is operable to relieve pressure on the sacral area of a patient resting on the patient support surface without rotating the patient support surface.

7. The adjustable bed of claim 1, further characterized in that:

one of the sections of the articulating, multi-sectioned base platform is an articulating torso support section;

the adjustable bed is operable to cause the controllable actuators to selectively elevate either a left or right side of the adjustable patient support framework to thereby tilt the patient adjustable support framework relative to the base platform while at least one platform-articulating actuator positions the torso support section in a substantially upright position;

whereby the patient support surface is modulated into a position that facilitates egress of a patient off of the patient support surface.

8. The adjustable bed of claim 1, further characterized in that each adjustable peripheral support vertex travels over an adjustable trajectory.

9. The adjustable bed of claim 1, further characterized in that each adjustable peripheral support vertex has at least two mechanically controllable degrees of freedom relative to section of the base platform to which the adjustable vertex is mounted.

10. The adjustable bed of claim 1, further characterized in that the principal arm comprises an inner rod that telescopes within an outer rod, the inner rod being driven by a linear actuator between extended and refracted positions.

11. The adjustable bed of claim 1, further characterized in that:

the principal arm comprises an inner rod that telescopes within an outer rod; and a cord is connected on one end to the telescoping inner rod and on an opposite end to a spring, the cord being mounted, at one or more intermediate points along the cord, on one or more pulleys, the cord being operable to cause the telescoping inner rod of the principal arm to extend.

12. An adjustable bed comprising:

a patient support surface having a head end, a foot end, a right side and a left side;

a patient support structure for supporting the patient support surface;

the patient support structure having a plurality of adjacent lateral patient support sections, including a first patient support section that extends from the right side to the left side of the patient support surface and that supports no more than 60% of the patient support surface;

the first patient support section having at least four vertices, including a superior right side vertex, a superior left side vertex, an inferior right side vertex, and an inferior left side vertex, wherein the superior vertices are closer to the head end than the inferior vertices;

a first side support bar linking the superior right side vertex to the inferior right side vertex;

a second side support bar linking the superior left side vertex to the inferior left side vertex;

wherein each of the first and second side support bars comprises an inner rod that telescopes within an outer rod so that the first and second side support bars each have adjustable lengths;

a flexible mattress-supporting foundation mounted to the first and second side support bars between the vertices of the first support section; and for each vertex, an independently controllable actuator coupled to and operable to independently raise that respective vertex relative to the other vertices.

13. The adjustable bed of claim 12, wherein the first patient support section is a torso support structure positioned to support the torso of a patient lying on the patient support surface.

14. The adjustable bed of claim 13, the torso support structure further comprising:

an intermediate right-side vertex intermediate the superior and inferior right side vertices;

an intermediate left side vertex intermediate the superior and inferior left side vertices;

a fifth independently controllable actuator coupled to and operable to independently raise the intermediate right-side vertex relative to the other vertices; and a sixth independently controllable actuator coupled to and operable to independently raise the intermediate left-side vertex relative to the other vertices.

15. The adjustable bed of claim 12, wherein the flexible mattress-supporting foundation consists essentially of a sheet mounted between the four vertices.

16. The adjustable bed of claim 12, wherein the flexible mattress-supporting foundation comprises a plurality of bands bridging first and second side support bars, wherein the first side support bar links the superior right side vertex to the inferior right side vertex, and the second side support bar links the superior left side vertex to the inferior left side vertex.

17. The adjustable bed of claim 12, wherein the controllable actuators coupled to a first support section vertex are mounted on a common bed frame section having a longitudinal axis; and wherein each of the controllable actuators coupled to a first support section vertex comprises a plurality of moving parts whose movements, relative to the common bed frame section, are confined to a transverse plane perpendicular to the longitudinal axis of the common bed frame section.

18. The adjustable bed of claim 17, wherein the common bed frame section articulates about a transverse axis of the adjustable bed.

19. The adjustable bed of claim 12, wherein each controllable actuator comprises:

a telescoping principal arm having superior and inferior ends, the inferior end of which is hingedly linked to the common bed frame section, and the superior end of which is joined to the first support section vertex corresponding to the controllable actuator of which the telescoping principal arm is a part;

a telescoping secondary arm having superior and inferior ends, the inferior end of which is hingedly linked to the common bed frame section and the superior end of which is hingedly joined to a midsection of the principal telescoping arm; and each of the telescoping principal and secondary arms comprising an inner rod, driven by a linear actuator, that telescopes within an outer rod.

20. The adjustable bed of claim 12, wherein each controllable actuator comprises:

a curved arm sliding within a curved guide;

a linear actuator hingedly mounted on one end to the common bed frame section and on an opposite end to the curved arm, and operable to move the curved arm between retracted and extended positions.

21. The adjustable bed of claim 12, wherein each controllable actuator comprises:

a curved arm sliding within a curved guide;

gear teeth disposed along a concave surface of the curved arm;

a rotary actuator with gear teeth adapted to mesh with the gear teeth of the curved arm, the rotary actuator being operable to drive the curved arm between retracted and extended positions.

22. An adjustable bed comprising:

a patient support surface having a head end, a foot end, a right side and a left side;

a patient support structure for supporting the patient support surface;

the patient support structure having a plurality of adjacent lateral patient support sections, including a first patient support section that extends from the right side to the left side of the patient support surface;

the first patient support section having at least four vertices, including a superior right side vertex, a superior left side vertex, an inferior right side vertex, and an inferior left side vertex, wherein the superior vertices are closer to the head end than the inferior vertices;

a flexible mattress-supporting foundation mounted to the first support section between the vertices; and for each vertex, an independently controllable actuator coupled to and operable to independently raise that respective vertex relative to the other vertices;

wherein the controllable actuators coupled to a first support section vertex are mounted on a common bed frame section having a longitudinal axis; and wherein each of the controllable actuators coupled to a first support section vertex comprises a plurality of moving parts whose movements, relative to the common bed frame section, are confined to a transverse plane perpendicular to the longitudinal axis of the common bed frame section;

wherein each controllable actuator comprises:

a sliding element;

a sliding guide that confines the movement of the sliding element to a horizontal linear segment within the transverse plane perpendicular to the longitudinal axis of the common bed frame section;

a principal arm having superior and inferior ends, the inferior end of which is hingedly linked to the sliding element, and the superior end of which is joined to the first support section vertex corresponding to the controllable actuator of which the principal arm is a part; and a secondary arm having superior and inferior ends, the inferior end of which is hingedly linked to the common bed frame section and the superior end of which is hingedly joined to a midsection of the principal arm.

23. The adjustable bed of claim 22, wherein the principal arm comprises an inner rod that telescopes within an outer rod.

24. The adjustable bed of claim 23, further comprising a linear actuator operable to drive the telescoping inner rod of the principal arm.

25. The adjustable bed of claim 23, further comprising a cord connected on one end to the telescoping inner rod and on an opposite end to a spring, the cord being mounted, at one or more intermediate points along the cord, on one or more pulleys, the cord being operable to cause the telescoping inner rod of the principal arm to extend.

26. The adjustable bed of claim 22, wherein the patient support surface is partially defined by a periphery, and each vertex of the patient support structure is positioned at or near the periphery of the patient support surface.

27. An adjustable bed comprising:

a patient support surface having a head end, a foot end, a right side and a left side;

a patient support structure for supporting the patient support surface;

the patient support structure having a plurality of adjacent lateral patient support sections, including a first patient support section that extends from the right side to the left side of the patient support surface, wherein the first patient support section is a torso support structure positioned to support the torso of a patient lying on the patient support surface;

the first patient support section having at least four vertices, including a superior right side vertex, a superior left side vertex, an inferior right side vertex, and an inferior left side vertex, wherein the superior vertices are closer to the head end than the inferior vertices;

a flexible mattress-supporting foundation mounted to the first support section between the vertices; and for each vertex, an independently controllable actuator coupled to and operable to independently raise that respective vertex relative to the other vertices;

the plurality of adjacent lateral patient sections also including a hip support structure positioned to support the hip of a patient lying on the patient support surface;

the hip support structure having a right side support bar and a left side support bar;

a fifth independently controllable actuator coupled to and operable to independently raise the right side support bar;

a sixth independently controllable actuator coupled to and operable to independently raise the left side support bar; and a flexible mattress-supporting foundation mounted to the hip support structure between the right side support bar and the left side support bar.

28. The adjustable bed of claim 27, further comprising:

a lower chassis mounted on wheels that enable the bed to be rolled;

an upper chassis mounted on the lower chassis for movement between Trendelenburg and reverse-Trendelenburg positions;

the patient support structure being mounted on the upper chassis;

the torso support structure of the patient support structure including an articulatable torso-support base structure mounted on the upper chassis, with the at least four vertices of the torso-support structure being mounted on the articulatable torso-support base structure;

the hip support structure of the patient support structure including an articulatable hip-support base structure mounted on the upper chassis, with the right and left side support bars of the hip support structure being mounted on the articulatable hip-support base structure;

one of the plurality of adjacent lateral support sections of the patient support structure being a central support structure hingedly connected to both the torso-support base structure and the hip-support base structure; and another of the plurality of adjacent lateral support sections of the patient support structure being a lower-leg support structure hingedly connected to the hip-support base structure.

* * * * *